US012758009B2

(12) United States Patent
Li

(10) Patent No.: US 12,758,009 B2
(45) Date of Patent: Oct. 13, 2026

(54) ELECTRIC LIFTING AND TILTING TABLE

(71) Applicant: BTA TECHNOLOGY LIMITED, Kowloon (HK)

(72) Inventor: Xiaohua Li, Shanghai (CN)

( * ) Notice: Subject to any disclaimer, the term of this patent is extended or adjusted under 35 U.S.C. 154(b) by 148 days.

(21) Appl. No.: 18/830,531

(22) Filed: Sep. 10, 2024

(65) Prior Publication Data

US 2026/0069030 A1 Mar. 12, 2026

(51) Int. Cl.
*A47B 21/02* (2006.01)
*A47B 13/08* (2006.01)
*A47B 21/04* (2006.01)

(52) U.S. Cl.
CPC ..... *A47B 21/02* (2013.01); *A47B 13/081* (2013.01); *A47B 13/088* (2013.01); *A47B 21/04* (2013.01); *A47B 2200/0056* (2013.01); *A47B 2200/0066* (2013.01)

(58) Field of Classification Search
CPC ..... A47B 21/02; A47B 21/04; A47B 13/081; A47B 13/088; A47B 2200/0053; A47B 2200/0066
USPC ..... 108/147, 3
See application file for complete search history.

(56) References Cited

U.S. PATENT DOCUMENTS 4,440,096 A * 4/1984 Rice ..... A47B 9/04 108/4
4,754,713 A * 7/1988 Chatenay epouse Compagnone ..... A63J 1/00 108/147
5,041,770 A * 8/1991 Seiler ..... A47B 21/00 318/265
5,224,429 A * 7/1993 Borgman ..... A47B 17/033 248/188.4
5,313,892 A * 5/1994 Tice ..... D05B 75/00 108/147
5,443,017 A * 8/1995 Wacker ..... A47B 17/02 108/5
5,857,415 A * 1/1999 Richard ..... A47B 21/0073 108/50.01
5,868,079 A * 2/1999 Charny ..... F16M 11/28 108/50.01
6,296,408 B1 * 10/2001 Larkin ..... A47C 7/72 400/681
7,677,678 B2 * 3/2010 Mosel ..... A61G 5/1094 312/231
9,993,068 B2 * 6/2018 Lin ..... A47B 9/00
10,709,236 B2 * 7/2020 Patrick ..... A47B 13/081
10,768,663 B2 * 9/2020 Carson ..... F16M 11/041
10,980,339 B2 * 4/2021 Game ..... A47B 21/04
(Continued)

*Primary Examiner* — Daniel J Troy
*Assistant Examiner* — Timothy M Ayres

(57) ABSTRACT

An electric lifting and tilting table consist of a monitor lifting and tilting system, a desktop part, a desktop lifting and tilting system, a side storage bracket, and an overall forward and backward moving system, wherein the desktop part is installed on the desktop lifting and tilting system, the monitor lifting and tilting system is installed above the desktop, and the monitor is installed on the monitor lifting and tilting system. The desktop lifting and tilting system can adjust the height or tilt posture of the desktop, the monitor lifting and tilting system can adjust the height or tilt posture of the monitor, and the overall forward and backward moving system can push the entire system to move forward and backward. Through the three adjustment systems, the monitor and the desktop can be kept at any position within a certain space.

5 Claims, 34 Drawing Sheets

(56) References Cited

U.S. PATENT DOCUMENTS

| | | | | |
|---|---|---|---|---|
| 11,129,471 | B1 * | 9/2021 | Oglesby | A47B 13/023 |
| 11,553,789 | B2 * | 1/2023 | Knapp | A47B 9/10 |
| 11,779,107 | B1 * | 10/2023 | Hernandez | A47B 13/081 108/2 |
| 2018/0000240 | A1 * | 1/2018 | Yamamoto | A47B 21/02 |

* cited by examiner

ELECTRIC LIFTING AND TILTING TABLE

FIELD OF THE INVENTION

The present application relates to intelligent study table and intelligent computer table technical field. More specifically, the present application relates to an electric lifting and tilting table.

BACKGROUND

With the continuous progress of ergonomics, there have been increasing demands for study tables and computer tables to be more adaptable. Traditional tables have fixed heights and angles that cannot be adjusted to meet individual needs. This can lead to physical health issues, especially for children during their growth period and long-term office workers. The present invention features a 6-axis 12-way adjustable desktop, allowing the display to be positioned anywhere in a given space to meet the needs of various groups of people.

SUMMARY

In various embodiments, an electric lifting and tilting table that can solve the shortcomings of the above technology, is provided.

As shown in FIG. 1-2, an electric lifting and tilting table, comprising a monitor lift and tilt system 100, a desktop part 200, a desk lift and tilt system 300, a side storage rack 400 and an overall forward and backward movement system 500; wherein the desktop part is installed on the desk lift and tilt system; wherein the monitor lifting and tilting system is installed on the desktop, and the monitor is installed on the monitor lifting and tilting system; wherein the desk lift and tilt system can adjust the height or tilt of the desktop, while the monitor lifting and tilting system can adjust the height or tilt of the monitor; wherein the overall forward and backward movement system can push the entire system to move forward and backward; wherein through these three adjustment systems, the monitor and the desktop can be kept in any position within a certain space.

Wherein, as shown in FIG. 1-12, the components of the monitor lift and tilt system 100 are a main support profile 101, a monitor frame lifting and fixing profile 102, a display frame lifting and moving profile 103, a monitor frame rotation fixing profile 104, an upper fixing plate 105, a rotating push frame 106, a rotation point fixing plate 107, a motor mount 108, a motor 109, a bottom fixing plate 110, a drive shaft 111, a screw gearbox 112, a screw nut 113, a screw 114, a built-in connecting plate 115, and a rotating and pushing nut 116; wherein a rotating and pushing nut 116, a rotating screw 117, a mobile end pin 118, a plug plate 119, a rotating frame shaft 120, a monitor converter board 121, a locking screw 122, a monitor horizontal support rod 123, a monitor vertical support bar 124, a monitor fixing plate 125, a rotating support plate 126, a rotating fixed axis 127, a display extension rod 128, a rotating joint plate 129, a rotating joint support rod 130, an extended monitor horizontal support 131, extended monitor vertical support 132, extended display mounting plate 133, screw rod 134, the relationship between the components: the plug plate 119 is welded to the bottom of the monitor frame lifting and fixing profile 102 and then connected to the main support profile 101 by bolts, the display frame lifting and moving profile 103 is sleeved on the monitor frame lifting and fixing profile 102 and can slide up and down, the display frame lifting and moving profile 103 is welded together through the bottom fixing plate 110 to form a support frame, and the built-in connecting plate 115 is connected through Bolts are connected to the two side surfaces of the upper part of the display frame lifting and moving profile 103 and the two side surfaces of the upper and lower ends of the monitor frame rotation fixing profile 104; the upper fixing plate 105 is respectively connected to the built-in connecting plate 115 by bolts to fix the display frame lifting and moving profile 103 and the monitor frame rotation fixing profile 104; one end of the rotating driving frame 106 is connected to the rotating driving nut 116 through the moving end pin 118; the other end is connected to the monitor vertical support bar 124 through the rotating driving frame shaft 120; wherein the rotation point fixing plate 107 is welded to the bottom fixing plate 110, the motor 109 is fixed to the motor mount 108 by bolts, the motor mount 108 is fixed to the display frame lifting and moving profile 103 by bolts passing through the screw gearbox 112, the drive shaft 111 passes through the motor 109 and the screw gearbox 112, the screw nut 113 is fixed to the top of the display frame lifting and fixing profile 102 by pins and is also sleeved on the screw 114, the top of the screw 114 is connected to the screw gearbox 112, the rotating pushing screw 117 is sleeved on the rotating pushing screw nut 116 and is also connected to the screw gearbox 112, the display is fixed on the monitor converter board 121, and then the monitor converter board 121 is fixed to the monitor fixing plate 125 by means of locking screws 122, the monitor horizontal support rod 123 and the monitor vertical support bar 124 are welded together to form a support frame, the rotation support plate 126 is welded to the monitor horizontal support rod 123, the rotation fixing shaft 127 passes through the rotation support plate 126 and the rotation point fixing plate 107 to form a rotation point, one end of the display extension rod 128 is inserted into the monitor horizontal support rod 123, and the other end is connected to the rotation joint support rod 130 through the rotation joint plate 129, one end of the extended monitor horizontal support 131 is welded to the extended monitor vertical support 132, and the other end is connected to the rotation joint support rod 130 through the rotation joint plate 129, and the extended display mounting plate 133 is fixed to the extended monitor horizontal support 131 by means of locking screws 122.

Wherein, as shown in FIG. 1, 2, 13-16, the desktop part 200 in the components is composed of a main desktop 201, an extended desktop 202, a desktop transverse reinforcement beam 203, a desktop longitudinal reinforcement beam 204, an extended desktop splint 205, a guide shaft 206, a mouse magnet fixing block 207, a mouse connection cord 208, and an object anti-sliding block 209. The main desktop 201 is installed on a frame welded together by the desktop transverse reinforcement beam 203 and the desktop longitudinal reinforcement beam 204, wherein the main desktop 201 is installed on a frame welded together by the desktop transverse reinforcement beam 203 and the desktop longitudinal reinforcement beam 204; wherein the material is a material that can attract magnets; wherein the extended desktop splint 205 is fastened to the extended desktop 202 by bolts; wherein the guide shaft 206 is installed on the extended desktop splint 205; wherein the mouse magnet fixing block 207 is adsorbed to the main desktop 201; wherein at the same time, the mouse magnet fixing block 207 is connected to one end of the mouse connection cord 208 and the other end is connected to the mouse through a type C plug; wherein the magnet embedded in the object anti-sliding block 209 can be adsorbed to the desktop, thereby preventing the object from sliding down when the desktop is tilted.

Wherein, as shown in FIG. 1, 2, 17-21, the components of the desk lift and tilt system 300 are casters 301, a bottom hinge plate 302, a bottom longitudinal reinforcement beam 303, a desktop lifting fixed profile 304, a desktop lifting movable profile 305, a front and rear movable support beam 306, a transverse reinforcement 307, a front swivel plate 308, a rotating fixed plate 309, a cantilever rack 310, a pillar 311, a rear rotating plate 312, a front and rear movable motor mounting plate 313, a lifting Motor mounting plate 314, rear leg lifting motor 315, front and rear moving motor 316, front leg lifting motor 317, screw drive rod 318, bottom joint pin 319, isolation support plate 320, friction plate 321, screw gearbox A 322, screw screw nut A 323, screw A 324, cantilever rack connecting pin 325, motor support plate support column 326, screw gearbox B 327, screw screw nut B 328, screw B 329, rotating and pushing screw nut B 329, locking reinforcement plate 330, the relationship between the components: the bottom hinge plate 302 connects the caster 301, the bottom longitudinal reinforcement beam 303, and the desktop lifting fixed profile 304 to form a fixed hinge point through bolts, and the bottom hinge plate 302 connects the caster 301 and the desktop lifting fixed profile 304 through the bottom joint pin 319. wherein the desktop lifting movable profile 305 is sleeved on the desktop lifting fixed profile 304, and bolts are passed through the locking reinforcement plate 330, the friction plate 321, the desktop lifting movable profile 305, the screw gearbox B 327, and the rotating fixed plate 309 to form a hinge point; wherein the front swivel plate 308 and the rear rotating plate 312 are respectively fixed to the front swivel plate 308 and the locking reinforcement plate 330 by pins to form a rotatable hinge point; wherein bolts are passed through the front and rear movable support beams 306, the isolation support plate 320, and the front swivel plate 308 to form a fixed connection at one end, and the other end is passed through the front and rear movable support beams 306 and the isolation support plate 320 by bolts; wherein the rear rotating plate 312 is fixed, the transverse reinforcing rib 307 is fixed on the top of the desktop lifting and moving profile 305 to form a frame, the cantilever rack 310 is connected to the screw nut A 323 through the cantilever rack connecting pin 325, the screw nut A 323 is sleeved on the rotating and pushing screw nut A 324, the rotating and pushing screw nut A 324 is fixed on the rotating and pushing nut gearbox A 322, the bolt passes through the support 311 and the lifting motor mounting plate 314 and is fixed to the rotating fixed plate 309, the front and rear moving motor mounting plate 313 is fixed to the rotating fixed plate 309 through the pin, and the front and rear moving motor 316 is fixed to the front and rear moving motor through the bolt. The rear leg lifting motor 315 is fixed to the lifting motor mounting plate 314 through the motor support plate support column 326, the front leg lifting motor 317 is fixed to the lifting motor mounting plate 314 through bolts, the screw nut B 328 is fixed to the upper end of the desktop lifting fixed profile 304 through a pin, one end of the rotating and pushing screw nut B 329 is fixed to the rotating and pushing nut gearbox B 327, the screw nut B 328 is sleeved on the rotating and pushing screw nut B 329, the rotating and pushing nut transmission rod 318 passes through the rotating and pushing nut gearbox B 327, the rear leg lifting motor 315, the front and rear moving motor 316, the front leg lifting motor 317, the screw nut A 323.

Wherein, as shown in FIGS. 1, 2, 22 and 23, the components of the side storage rack 400 are a bottom storage platform 401, a vertical support rod 402, a horizontal pull rod 403, a side small table 404, a top-level framework connecting plate 405, and a top-level framework 406; wherein the components are related as follows: the vertical support rod 402 is welded to the bottom storage platform 401, the horizontal pull rod 403 is welded to the vertical support rod 402, the top-level framework connecting plate 405 is welded to the top-level framework 406 and the side small table 404, the frame fixing plate 407 is welded to the desk lift and tilt system 300; wherein the desktop lifting and moving profile 305, the horizontal pull rod 403 is fixed to the frame fixing plate 407 by bolts.

Wherein, as shown in FIGS. 1, 2, 24 and 25, the components of the overall forward and backward movement system 500 are a fixed rod 501, a suction cup 502, a frame moving motor support plate 503, a frame moving motor 504, a screw gearbox C 505, a putter 506, and a screw C 507; wherein the relationship between the components is as follows: the suction cup 502 is installed on the fixed rod 501, the screw gearbox C 505 and the frame moving motor 504 are fixed on the frame moving motor support plate 503, the putter 506 is connected to the screw C 507, and the screw C 507 is fixed on the locking reinforcement plate 330 of the desk lift and tilt system 300.

1. Suitable for accommodating diverse desktop or monitor needs in various positions and postures.
2. Easy to use, with one-click adjustment to the desired position using an APP control with a memory function.
3. No intermediate beam design.
4. Innovative desktop tilt structure.
5. Large distance forward and backward movement design, ideal for various reclining chair angles during work.
6. Beautiful and elegant, suitable for home and office use.

BRIEF DESCRIPTION OF THE DRAWINGS

The technology may be more completely understood in connection with the following drawings, in which.

Figure 1:
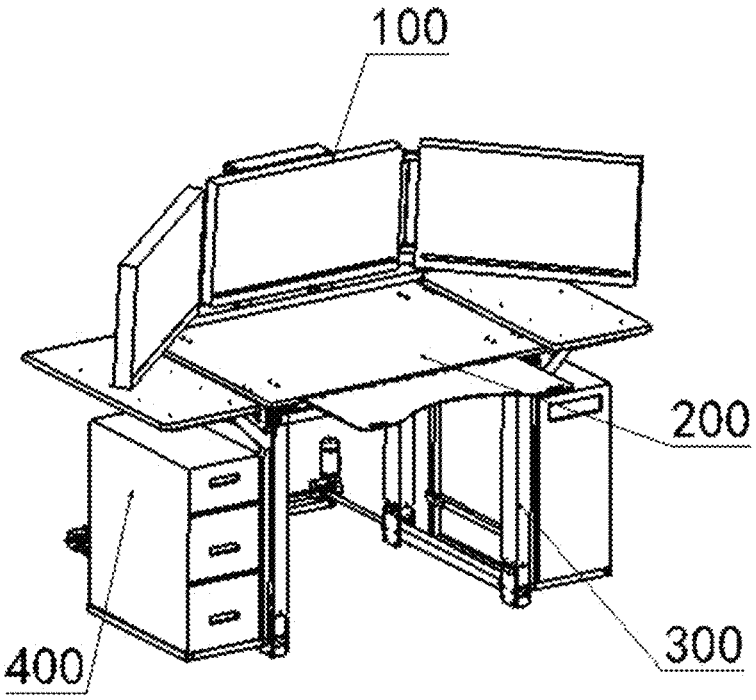
FIG. 1 is a front view of an electric lifting and tilting table, according to an embodiment.
Figure 2:
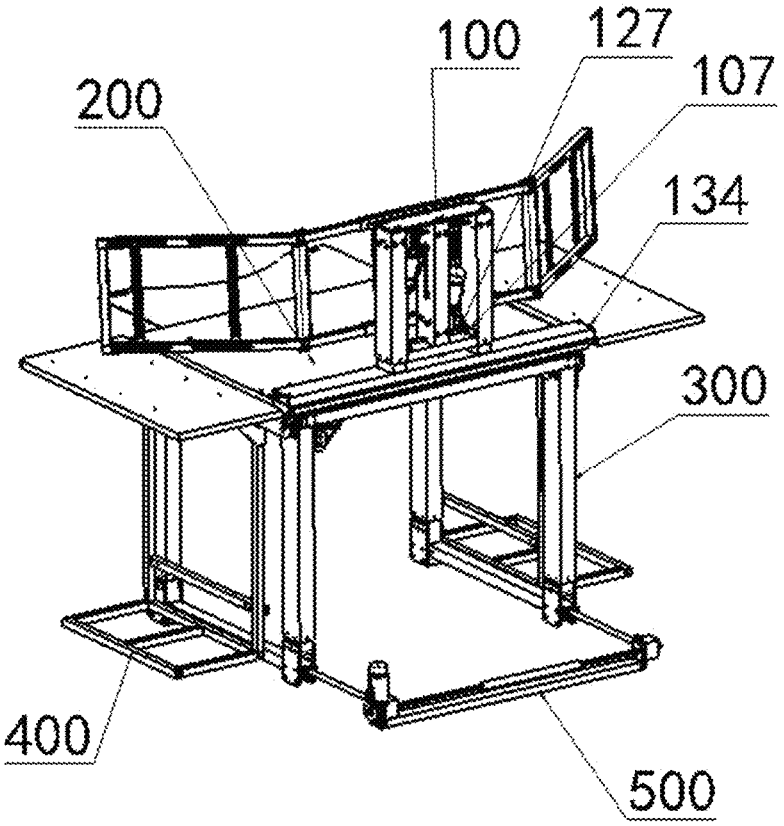
FIG. 2 is a rear view of an electric lifting and tilting table, according to an embodiment.
Figure 3:
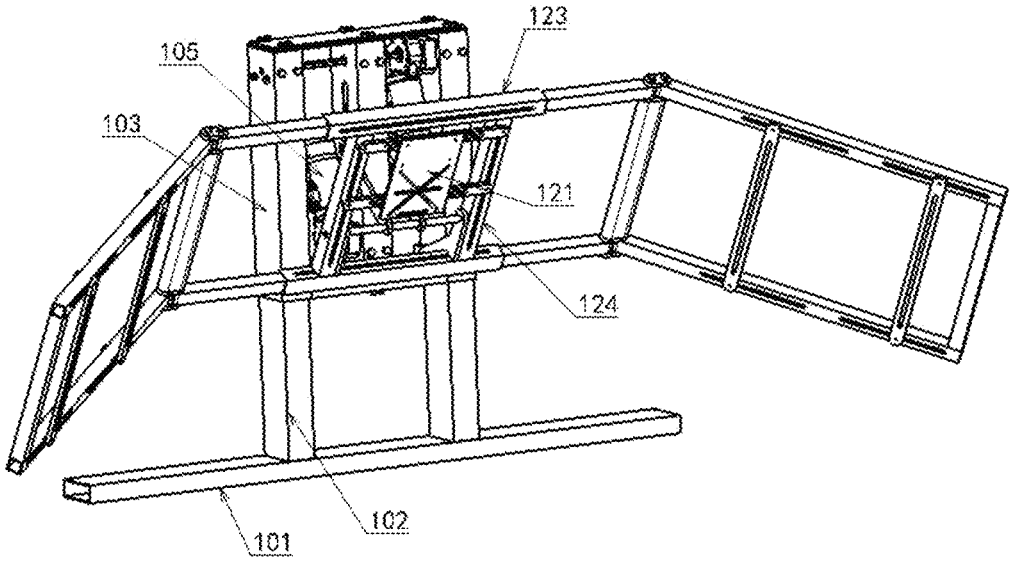
FIG. 3 is an overall front view of the monitor lift and tilt system, according to an embodiment.
Figure 4:
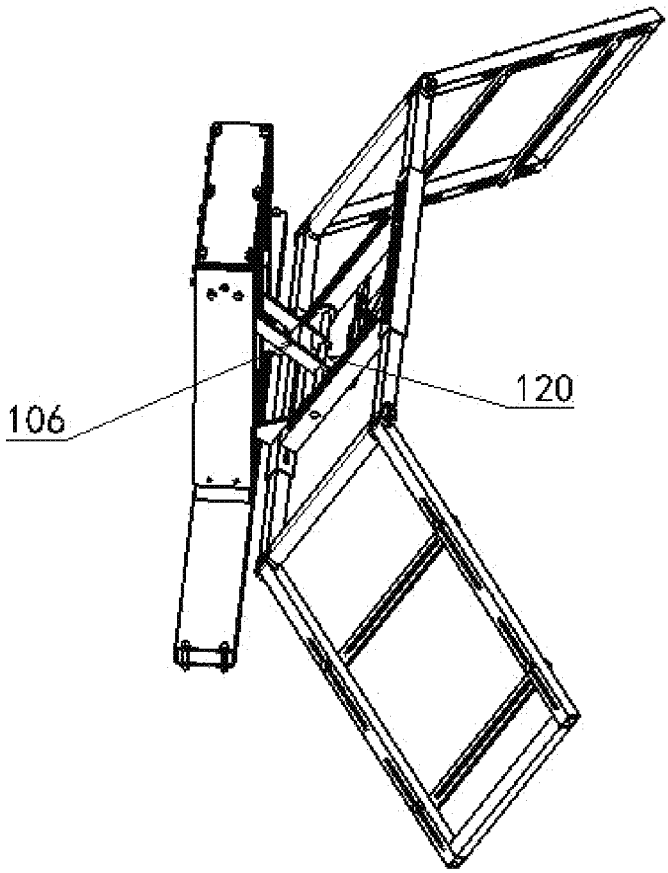
FIG. 4 is a top view of the monitor lift and tilt system, according to an embodiment.
Figure 5:
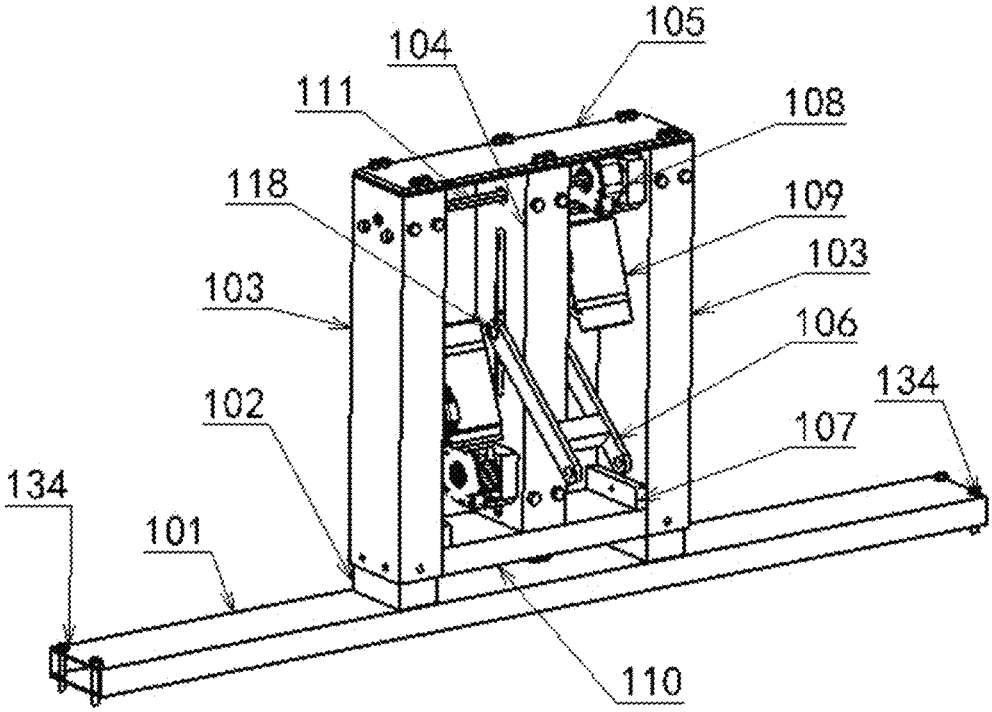
FIG. 5 is a front view of the lift and tilt frame, according to an embodiment.
Figure 6:
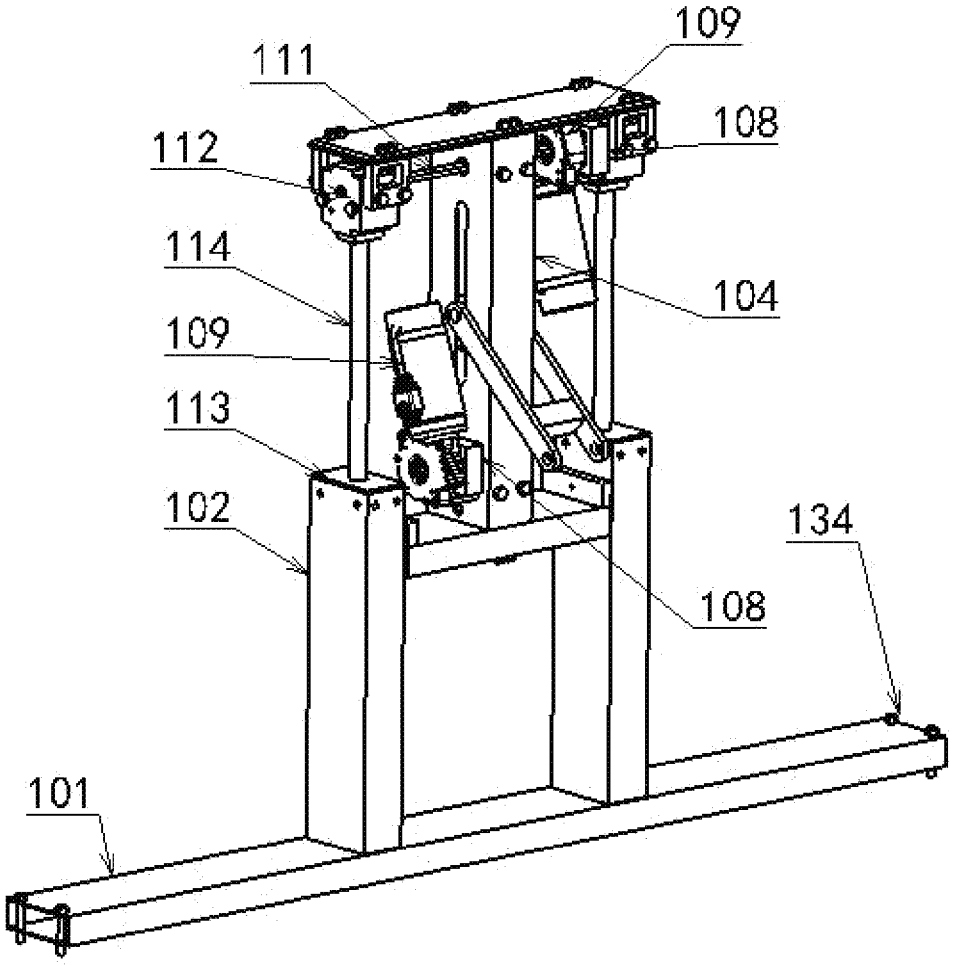
FIG. 6 is an inside view of the lift and tilt frame, according to an embodiment.
Figure 7:
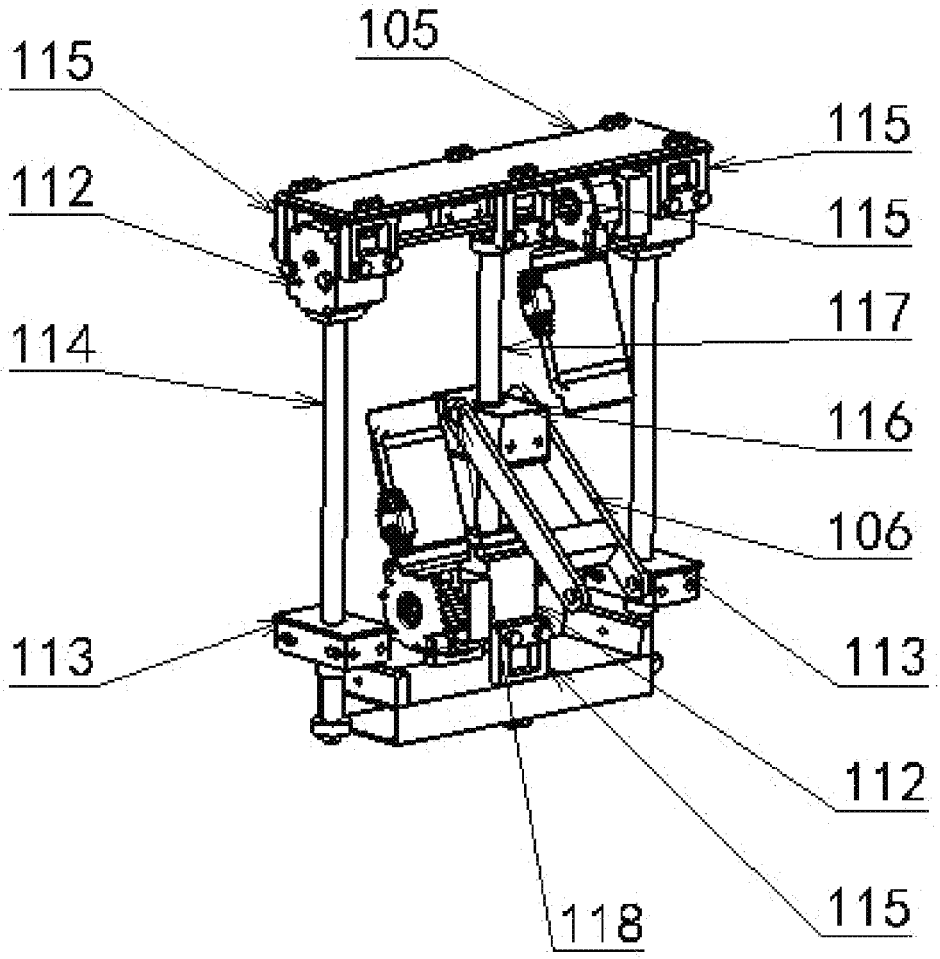
FIG. 7 is another inside view of the lift and tilt frame, according to an embodiment.
Figure 8:
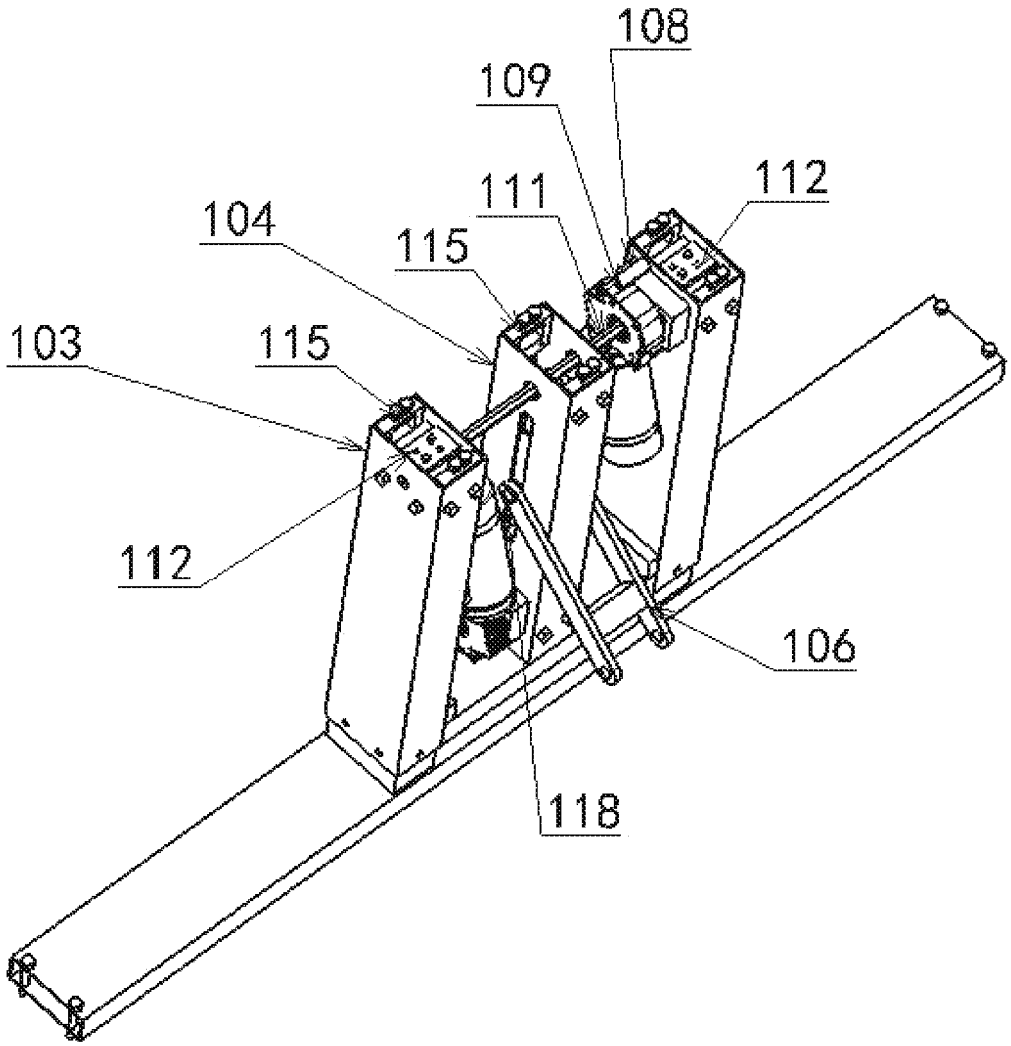
FIG. 8 is a top view of the lift and tilt frame, according to an embodiment.
Figure 9:
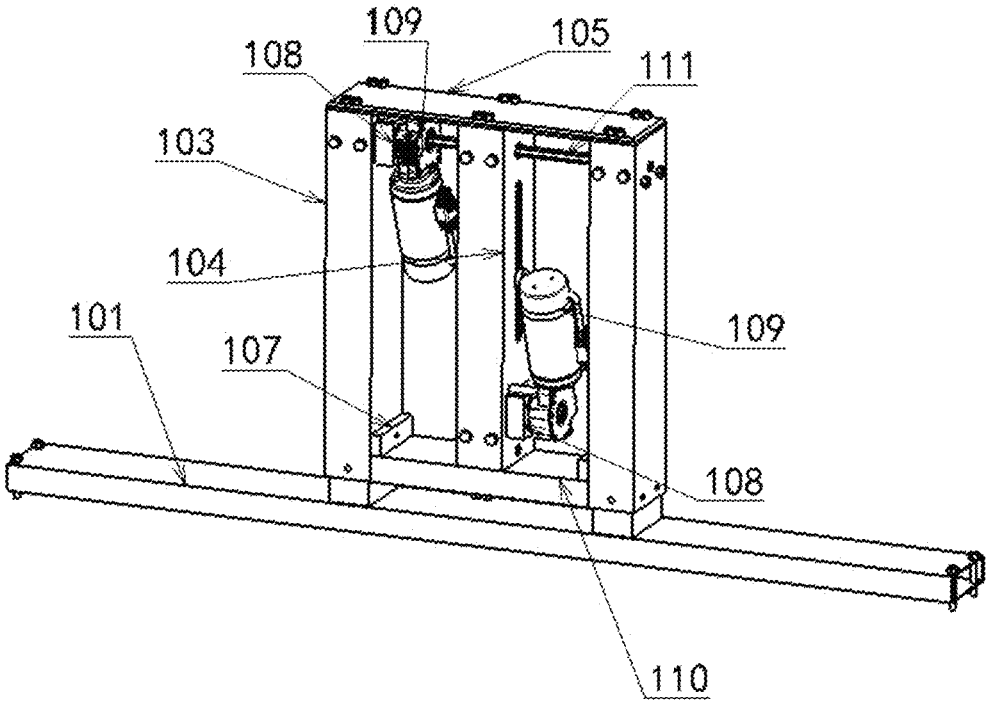
FIG. 9 is a back view of the lift and tilt frame, according to an embodiment.
Figure 10:
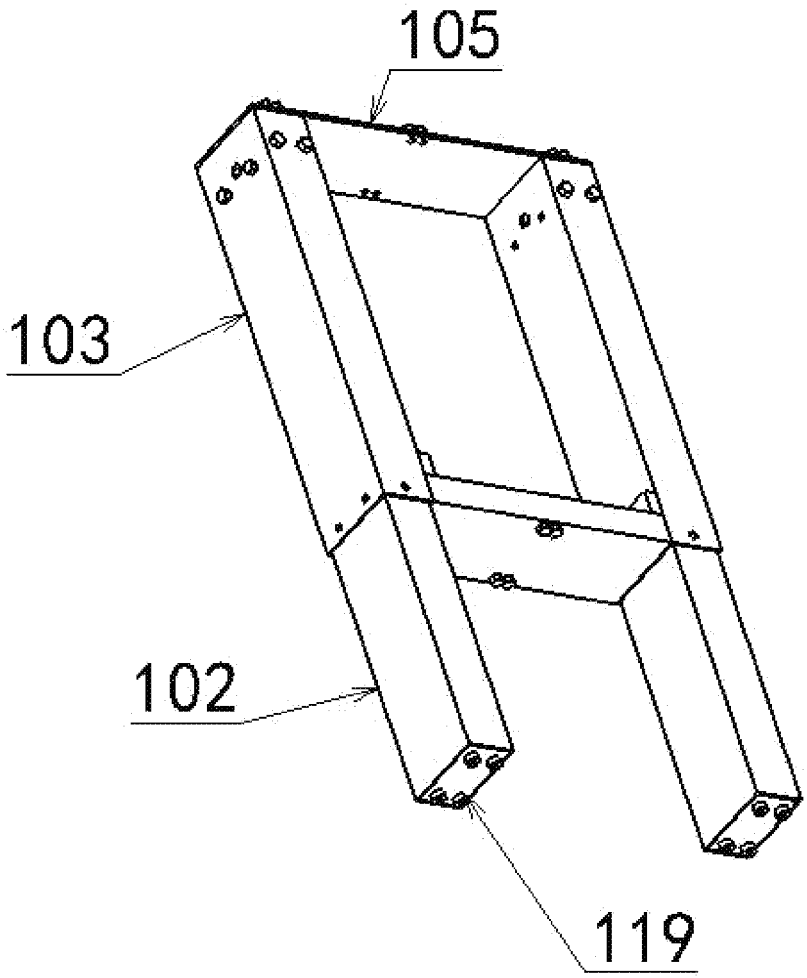
FIG. 10 is a bottom view of the lift and tilt frame, according to an embodiment.
Figure 11:
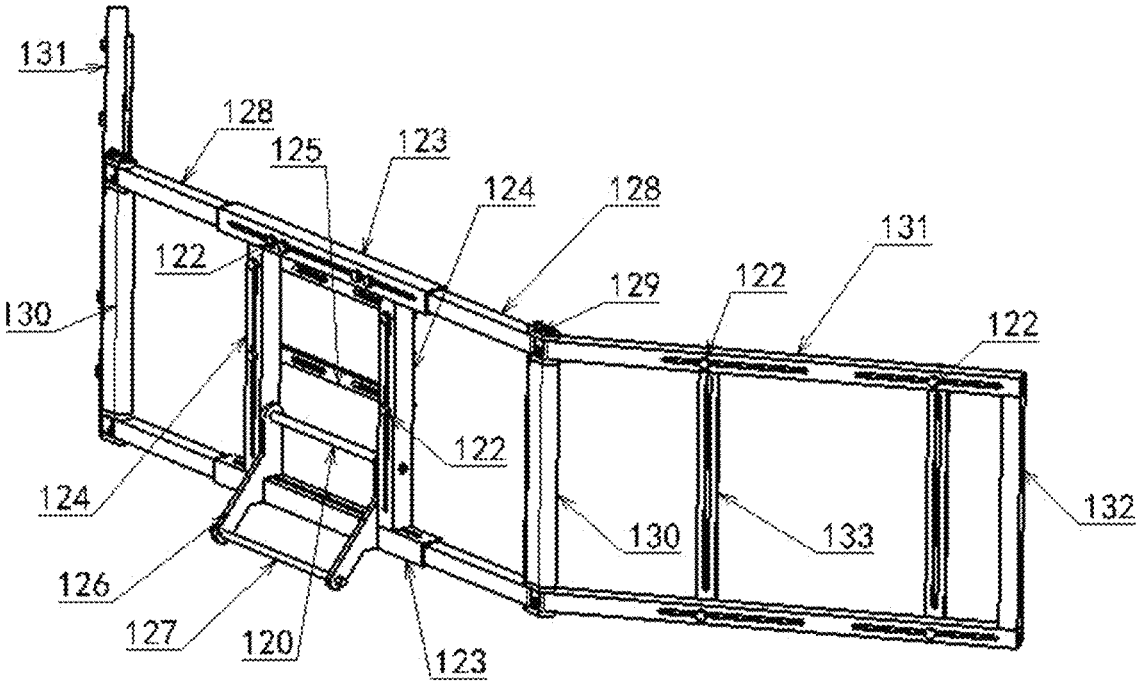
FIG. 11 is a back view of the monitor mounting frame, according to an embodiment.
Figure 12:
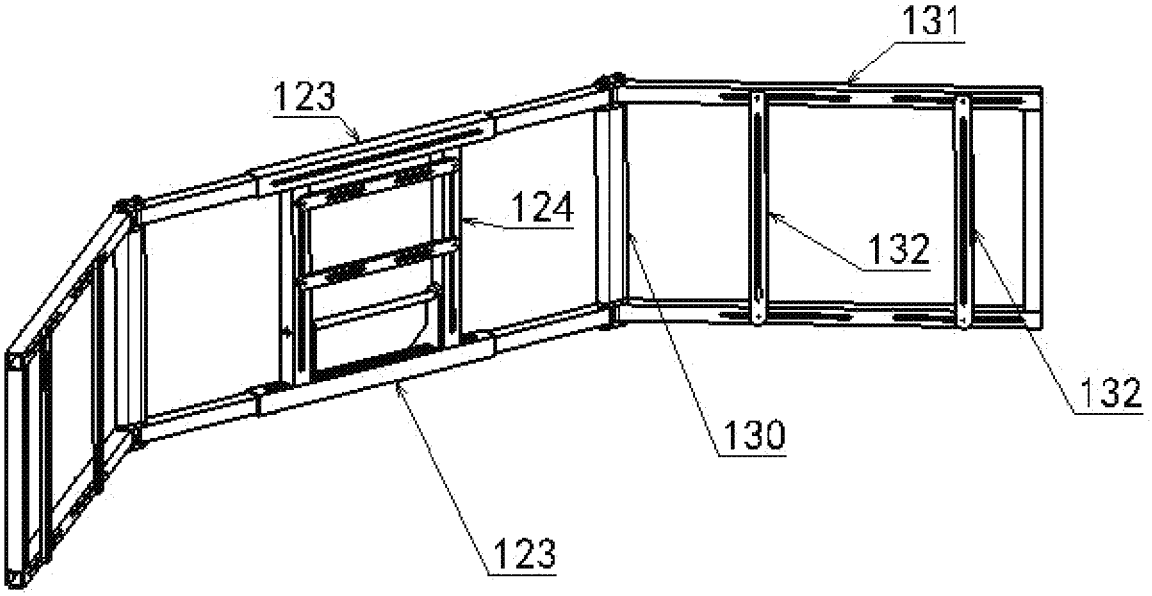
FIG. 12 is a front view of the monitor mounting frame, according to an embodiment.
Figure 13:
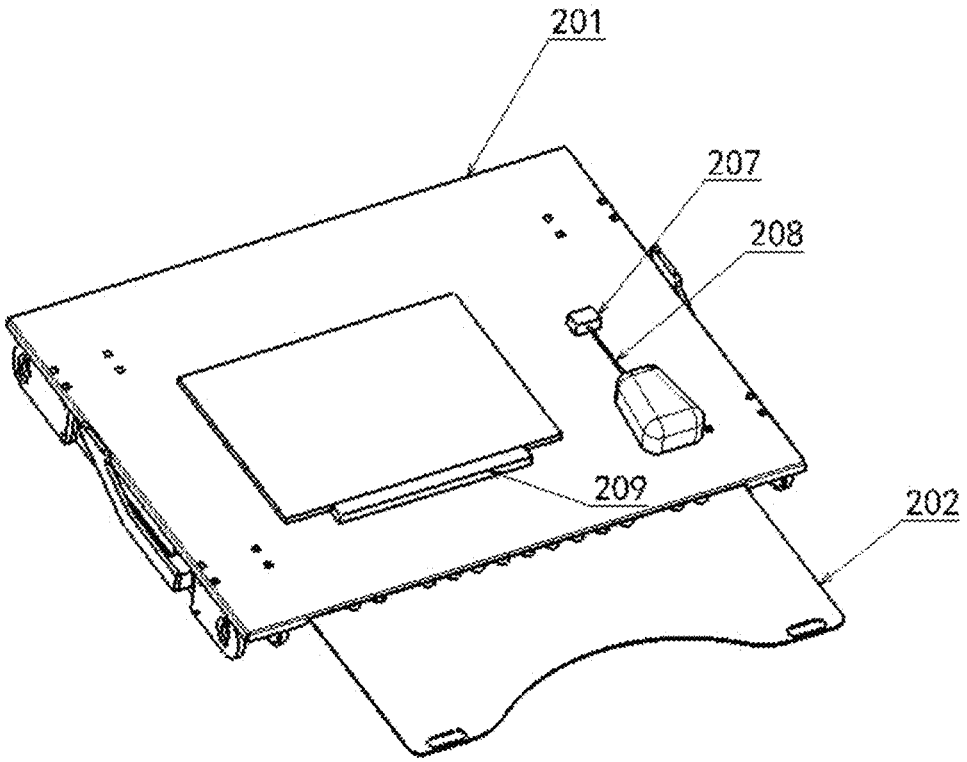
FIG. 13 is a front view of the main desktop, according to an embodiment.
Figure 14:
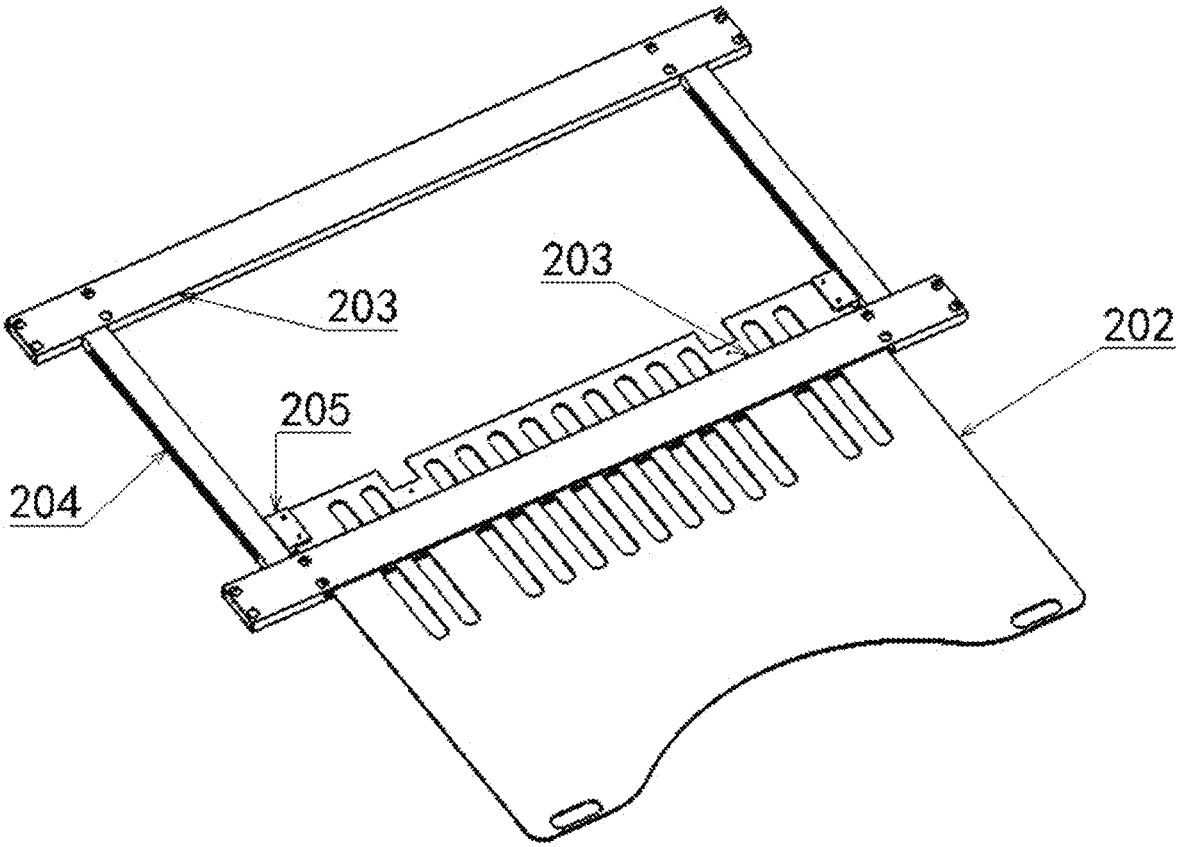
FIG. 14 is a back view of the main desktop, according to an embodiment.
Figure 15:
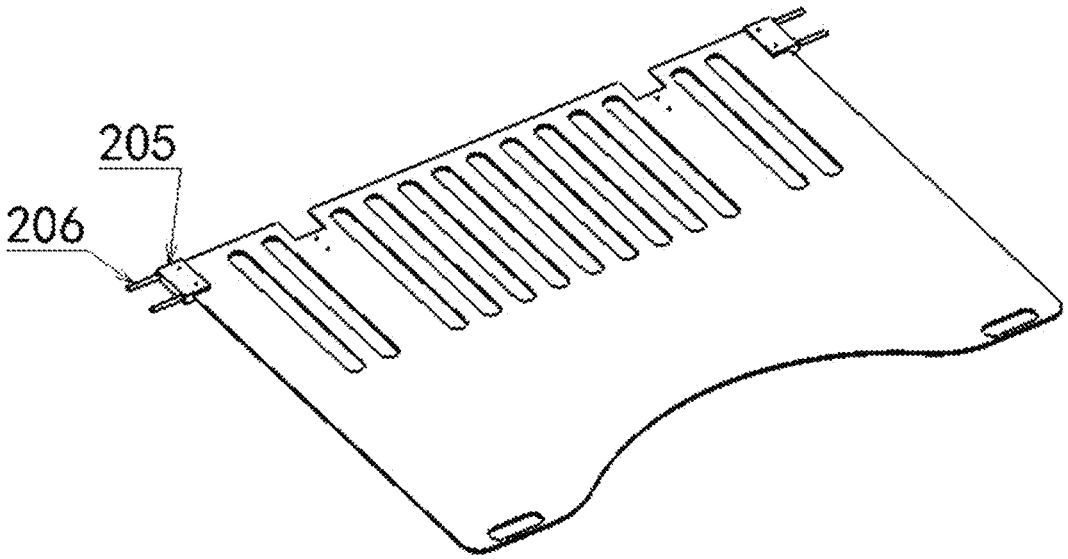
FIG. 15 is a schematic view of the connection between the pull-out plate and the guide plate.
Figure 16:
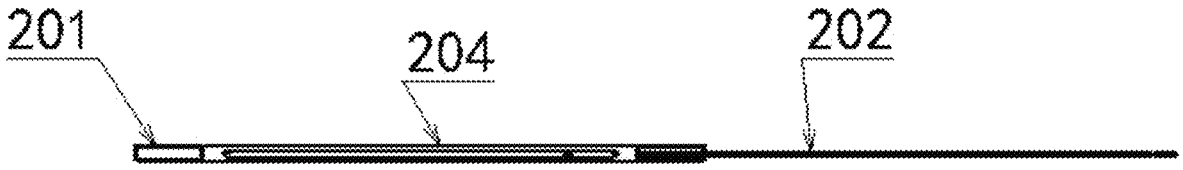
FIG. 16 is a plan view of the main desktop, according to an embodiment.
Figure 17:
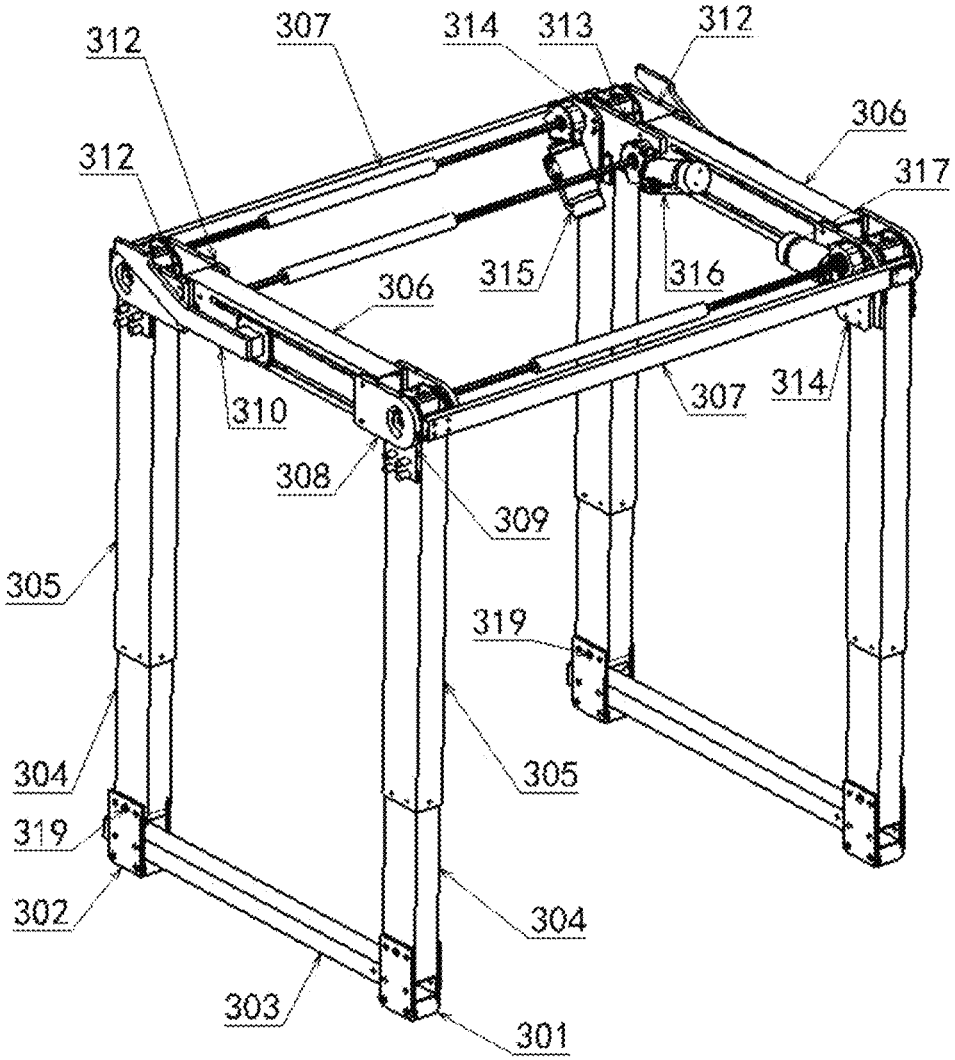
FIG. 17 is an overall view of the desktop lift and tilt system, according to an embodiment.
Figure 18:
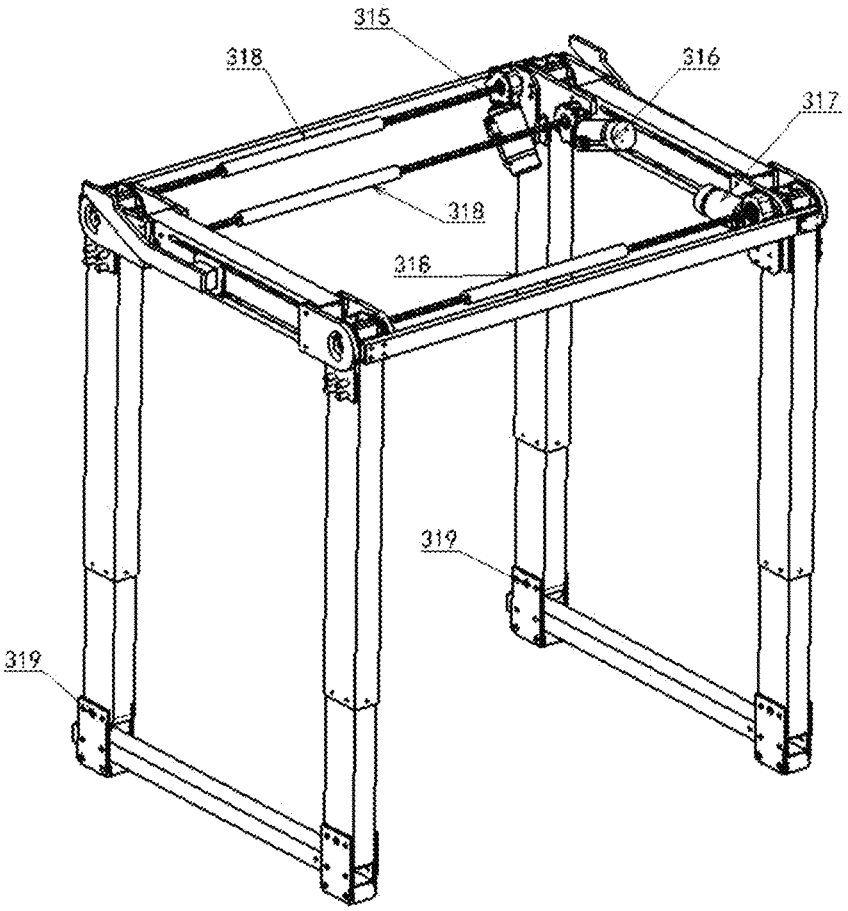
FIG. 18 is a schematic view of the drive section of the desktop lifting and tilting system, according to an embodiment.
Figure 19:
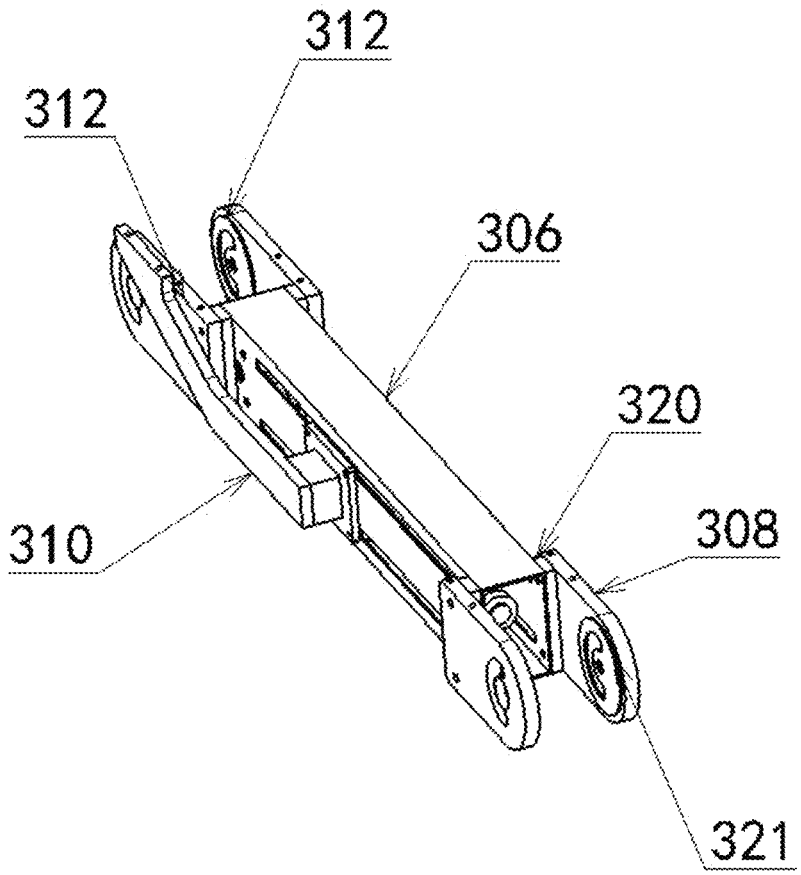
FIG. 19 is a detailed structural view of driving the display frame to move forward and backward, according to an embodiment.
Figure 20:
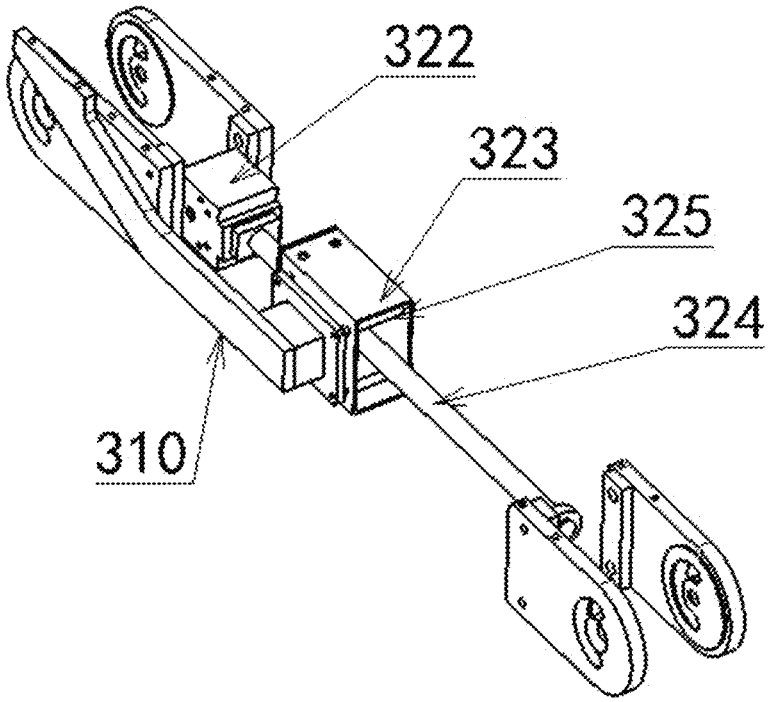
FIG. 20 is a schematic view of the internal structure of the drive display frame to move forward and backward, according to an embodiment.
Figure 21:
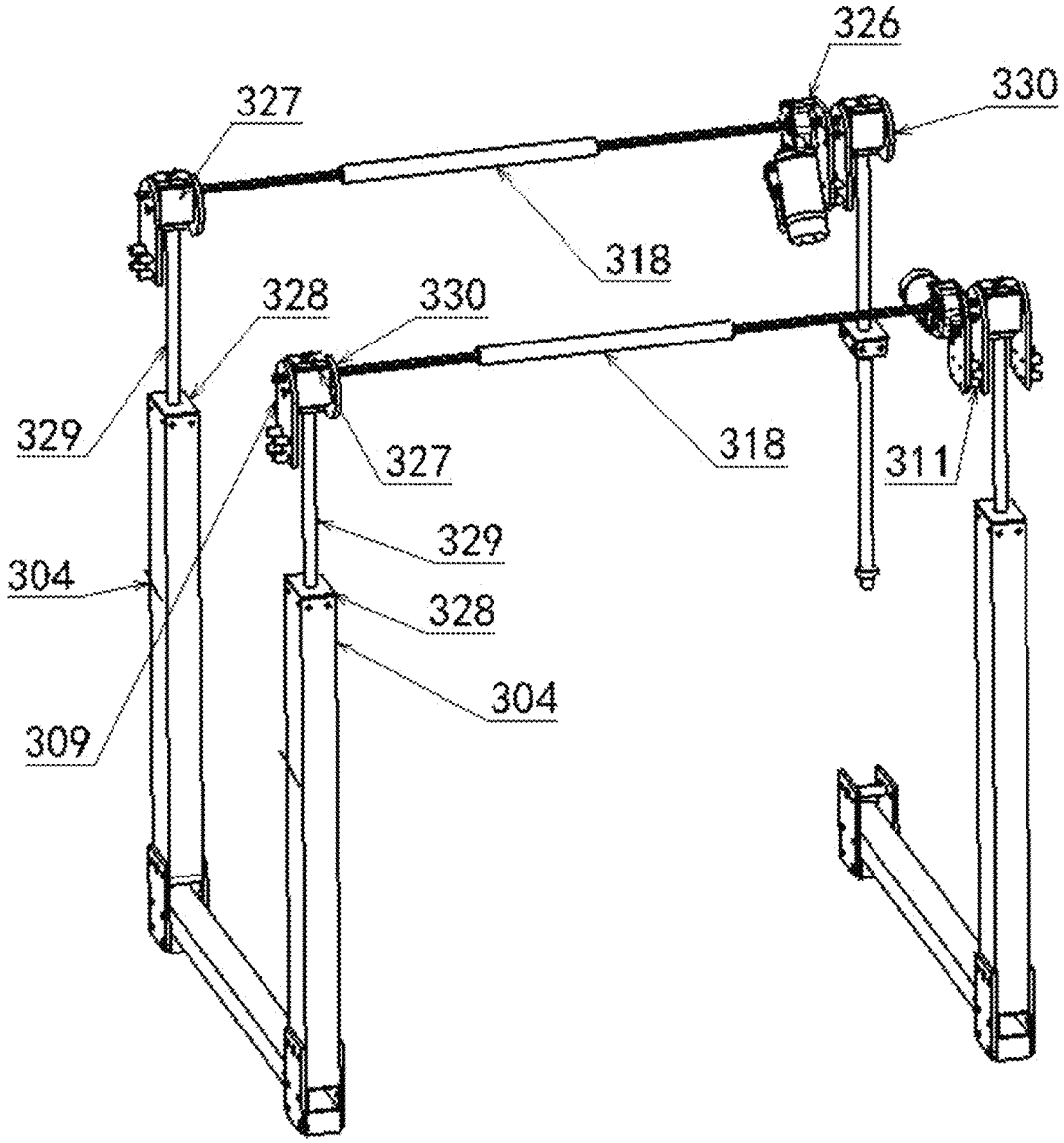
FIG. 21 is a Schematic view of the detailed internal structure of the desktop lifting and tilting system.
Figure 22:
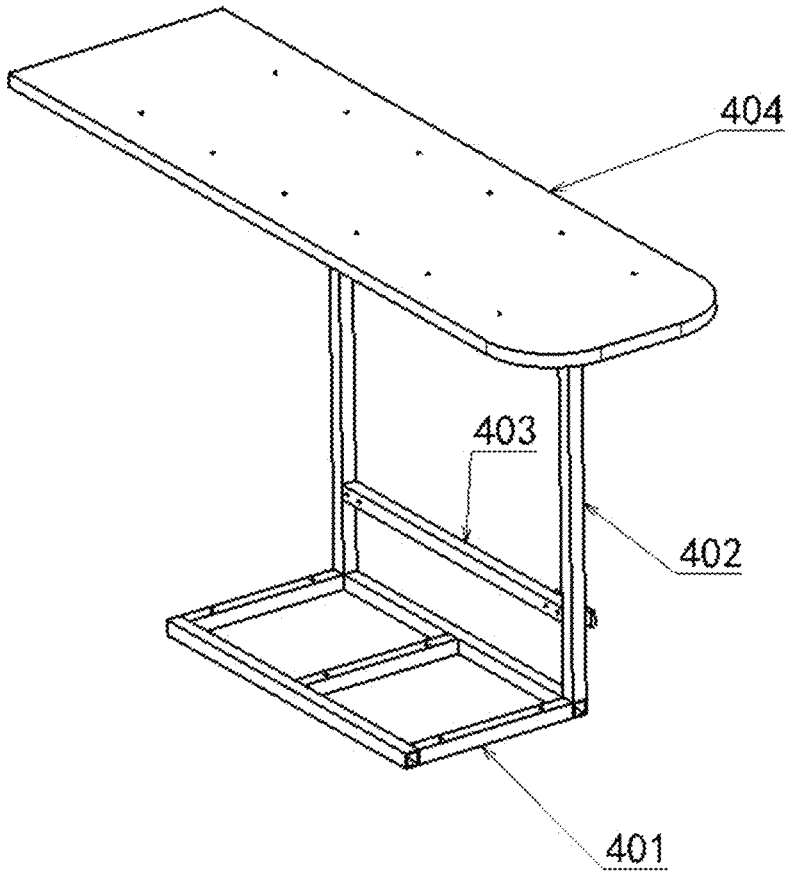
FIG. 22 is a front view of the side solid storage bracket structure.
Figure 23:
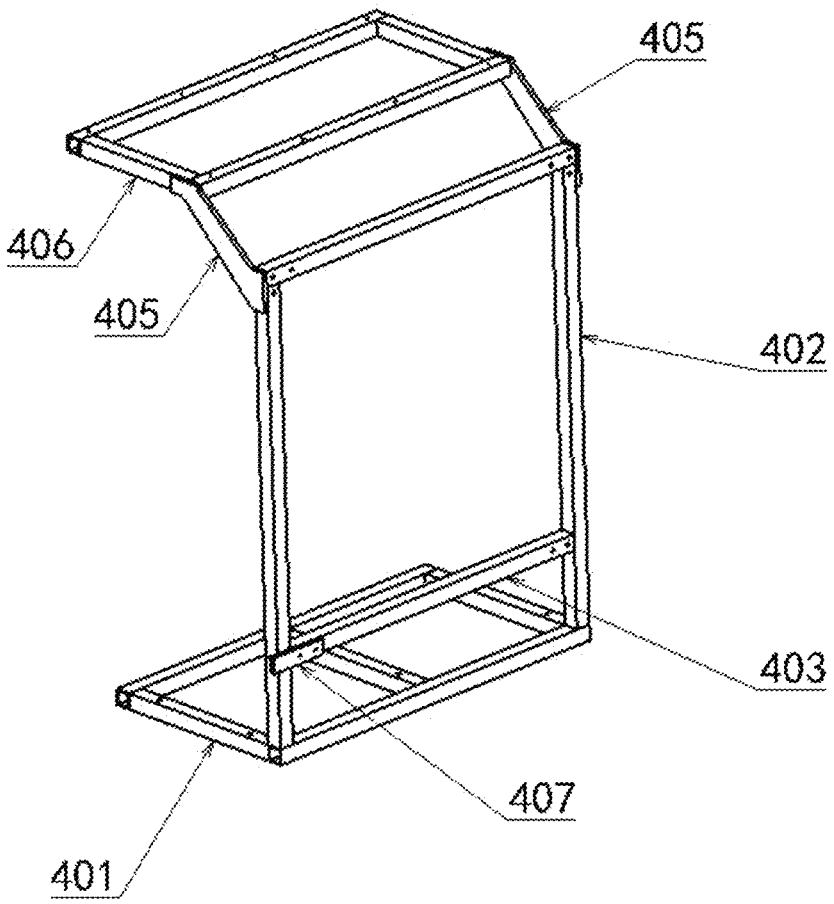
FIG. 23 is a side view of the side solid storage bracket structure.
Figure 24:
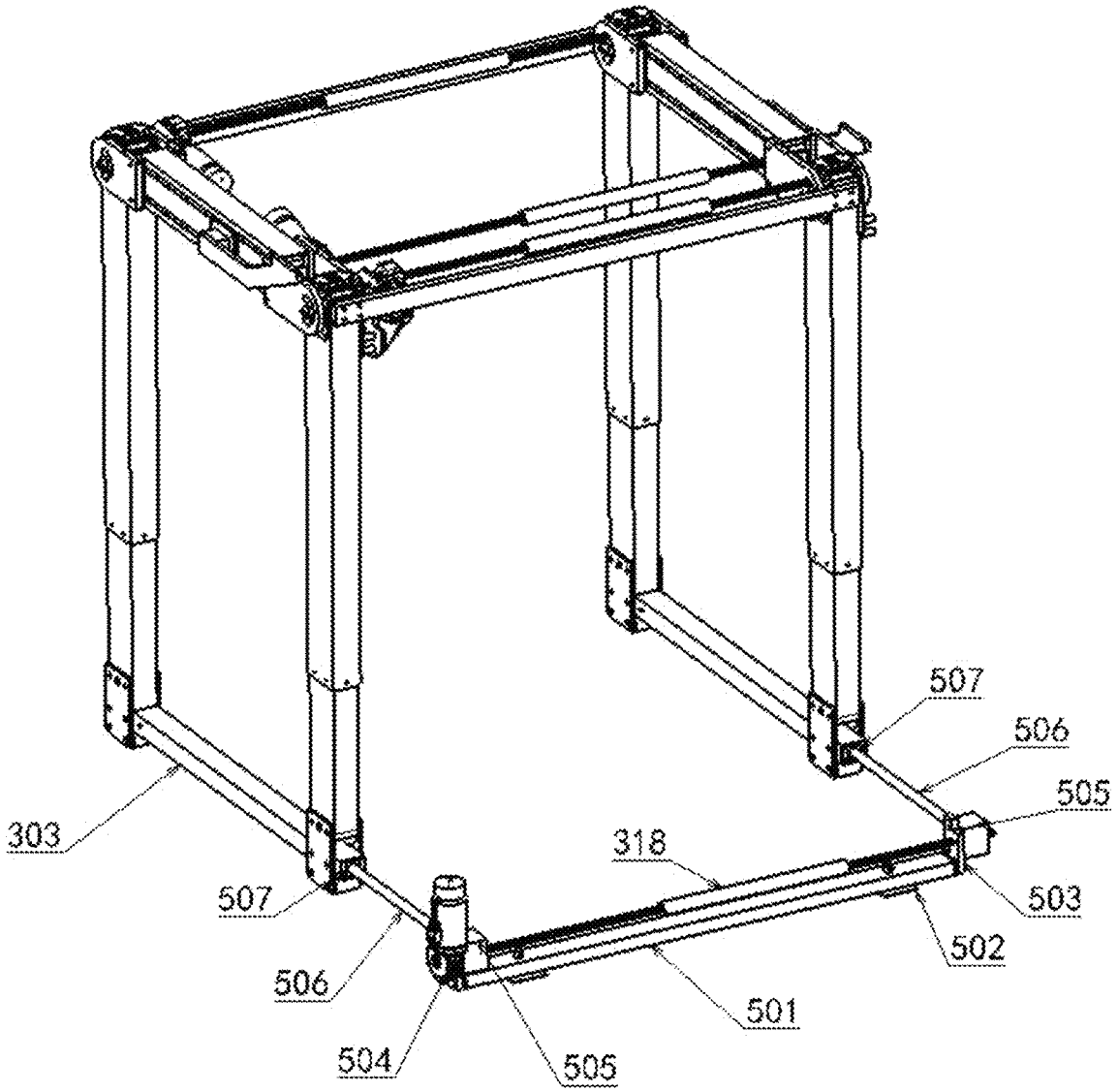
FIG. 24 is an overall schematic view of the overall forward and backward movement system.
Figure 25:
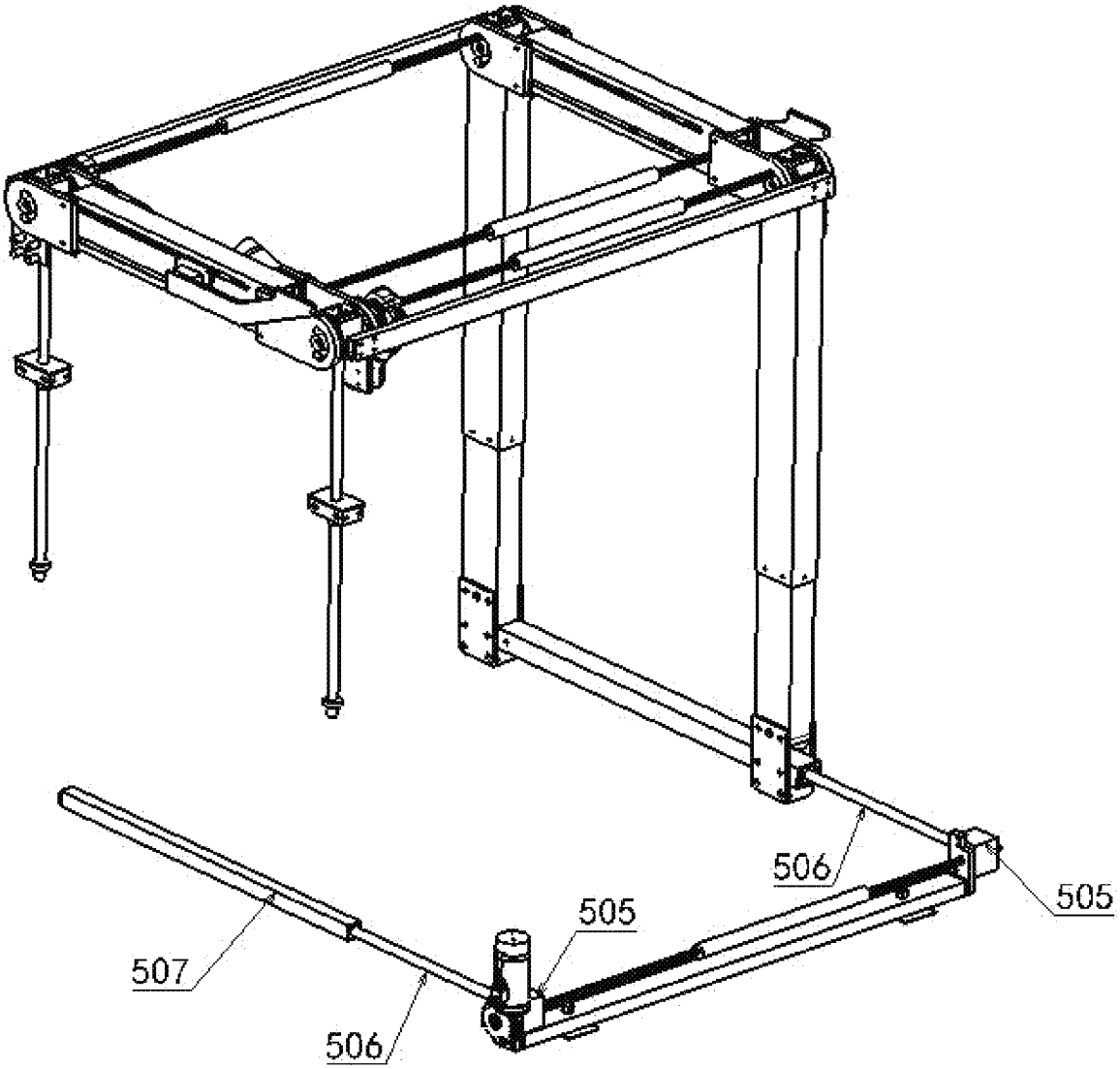
FIG. 25 is a schematic view of the internal structure of the overall forward and backward movement system.

100. monitor lift and tilt system
101. main support profile
102. monitor frame lifting and fixing profile
103. monitor frame lifting and moving profile
104. monitor frame rotation fixing profile
105. upper fixing plate
106. rotating push frame
107. rotation point fixing plate
108. motor mount
109. drive motor
110. bottom fixing plate
111. drive shaft
112. screw gearbox
113. screw nut
114. screw
115. built-in connection plate
116. rotating and pushing nut
117. rotating screw
118. mobile end pin
119. plug plate
120. rotating frame shaft
121. monitor converter board
122. locking screw
123. monitor horizontal support rod
124. monitor vertical support bar
125. monitor fixing plate
126. rotating support plate
127. rotating fixed axis
128. monitor extension rod
129. rotary joint plate
130. rotating joint support rod
131. extended monitor horizontal support
132. extended monitor vertical support
133. extended display mounting plate
134. screw rod
200. desktop part
201. main desktop
202. extended desktop
203. tabletop transverse reinforcement beam
204. tabletop longitudinal reinforcement beam
205. extended desktop splint
206. guide shaft
207. mouse magnet fixing block
208. mouse connection cord
209. object anti-sliding block
300. desk lift and tilt system
301. caster
302. bottom hinge plate
303. bottom longitudinal reinforcement beam
304. desktop lifting fixed profile
305. desktop lifting and moving profile
306. front and rear movable support beam
307. transverse reinforcement
308. front swivel plate
309. rotating fixed plate
310. cantilever rack
311. pillar
312. rear rotating plate
313. front and rear movable motor mounting plate
314. lifting motor mounting plate
315. rear leg lifting motor
316. front and rear movement motor
317. front leg lifting motor
318. screw drive rod
319. bottom joint pin
320. isolation support plate
321. friction plate
322. screw gearbox A
323. screw screw nut A
324. screw A
325. cantilever rack connecting pin
326. motor support plate support column
327. screw gearbox B
328. screw screw nut B
329. screw B
330. locking reinforcement plate
400. side storage rack
401. bottom storage platform
402. vertical support rod
403. horizontal pull rod
404. side small table
405. top frame connecting plate
406. top-level framework
407. frame fixing plate
500. overall forward and backward movement system
501. fixed rod
502. suction cup
503. frame moving motor support plate
504 □□□□□□ frame moving motor
505. screw gearbox C
506. Putter
507. screw C While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the

DETAILED DESCRIPTION OF EMBODIMENTS

The embodiment of the present technology described herein are not intended to be exhaustive or to limit the technology to the precise forms disclosed in the following detailed description. Rather, the embodiment are chosen and described so that others skilled in the art can appreciate and understand the principles and practices of the present technology.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

Figure 26:
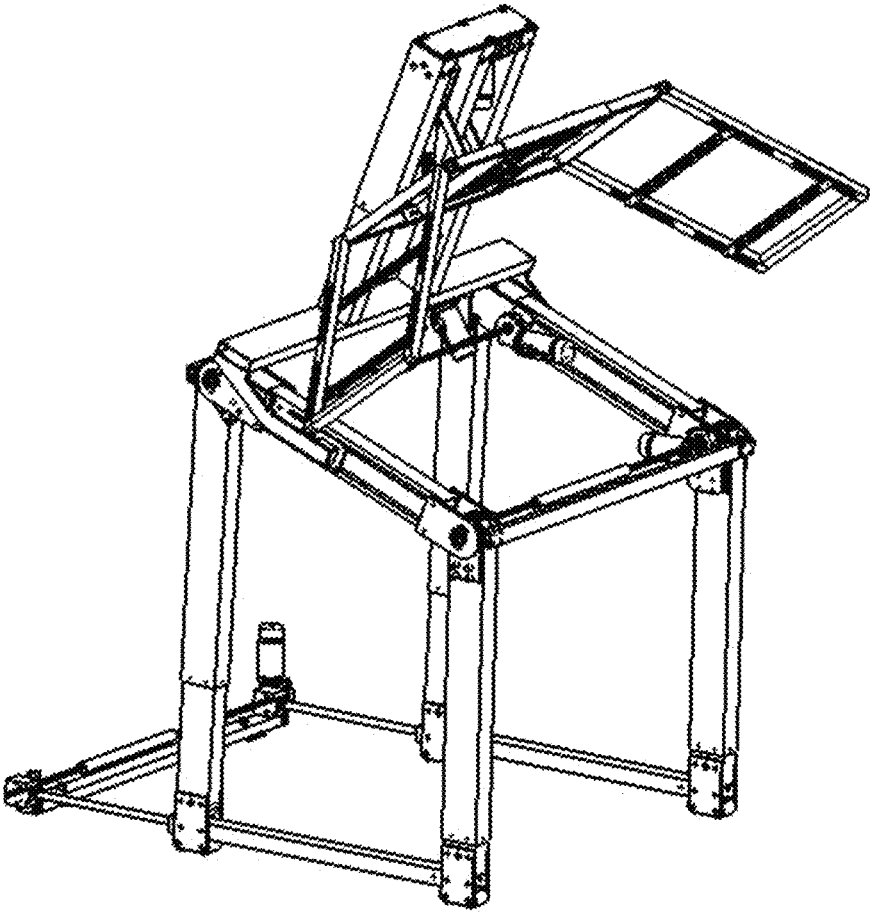
FIG. 26 is a schematic view of position during movement 1.

Movement status as shown in FIG. 26, the two rear legs, i.e., the rear desktop lifting and moving profile 305, are lifted and lowered in a specific manner: the rear leg lifting motor 315 rotates clockwise to drive the screw drive rod 318 to rotate, the screw drive rod 318 drives the screw gearbox B 327 to rotate, the screw gearbox B 327 drives the screw B 329 to rotate, the screw B 329 rotates to drive the screw nut B 328 to move linearly downward, and since the screw nut B 328 is fixed on the desktop lifting fixed profile 304, a reverse thrust is provided to push the screw B 329 to drive the screw gearbox B 327 to move upward, and since the screw gearbox B 327 is fixed on the desktop lifting and moving profile 305, the rear desktop lifting and moving profile 305 is moved upward, and conversely, the rear leg lifting motor 315 rotates counterclockwise to move the desktop lifting and moving profile 305 downward.

Figure 27:
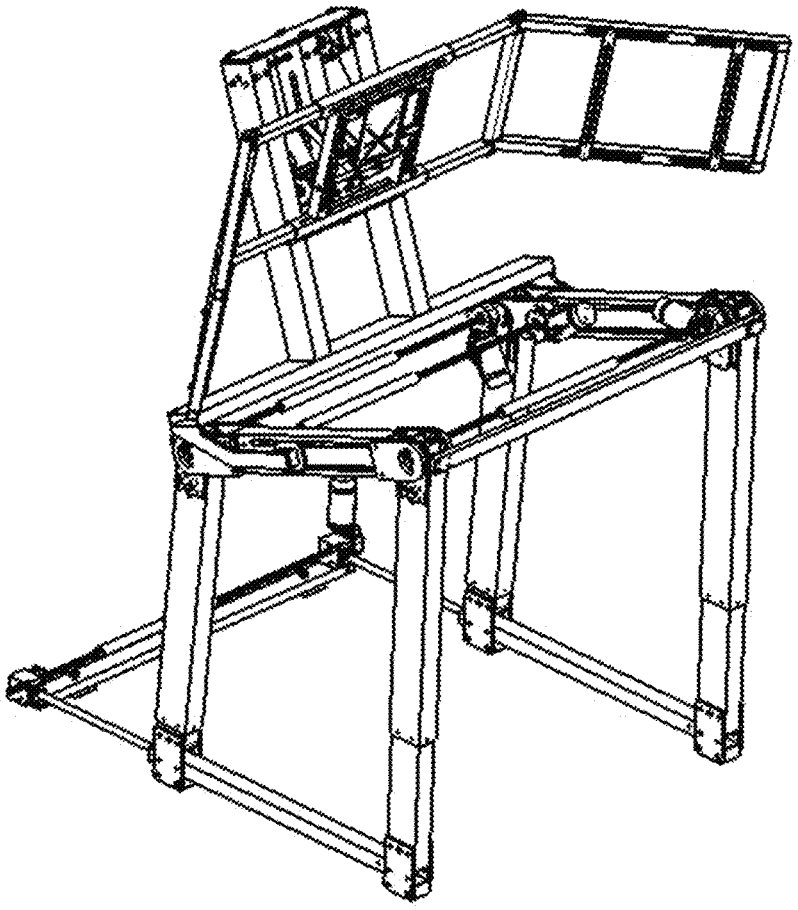
FIG. 27 is a schematic view of position during movement 2.

Movement status as shown in FIG. 27, the front two legs, i.e., the front desktop lifting and moving profile 305, are lifted and lowered in the following specific manner: the front leg lifting motor 317 rotates clockwise to drive the screw drive rod 318 to rotate, the screw drive rod 318 drives the screw gearbox B 327 to rotate, the screw gearbox B 327 drives the screw B 329 to rotate, the screw B 329 rotates to drive the screw nut B 328 to move linearly downward, and since the screw nut B 328 is fixed on the desktop lifting fixed profile 304, a reverse thrust is provided to push the screw B 329 to drive the screw gearbox B 327 to move upward, and since the screw gearbox B 327 is fixed on the desktop lifting and moving profile 305, the desktop lifting and moving profile 305 is moved upward, and conversely, the front leg lifting motor 317 rotates counterclockwise to move the desktop lifting and moving profile 305 downward.

Figure 28:
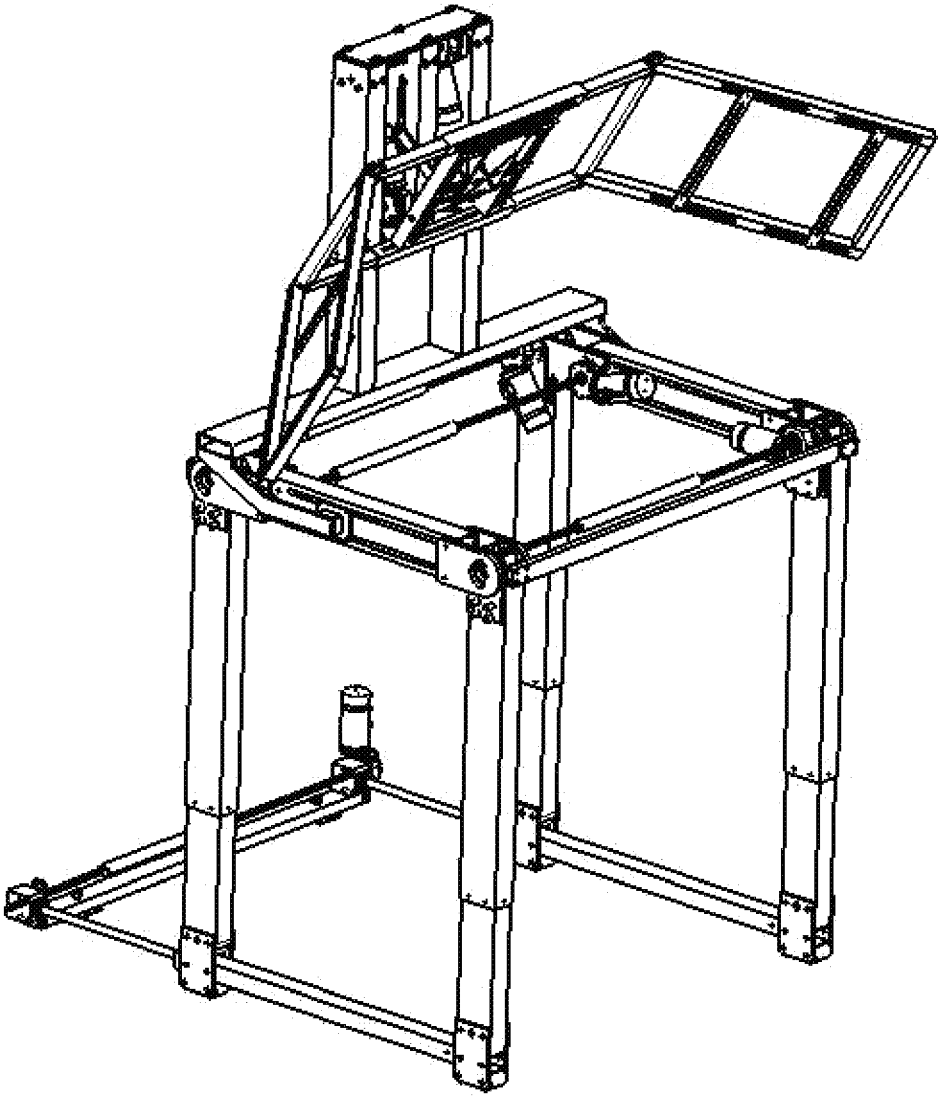
FIG. 28 is a schematic view of position during movement 3.

Movement status as shown in FIG. 28, the two front legs, i.e., the front desktop lifting and moving profile 305 and the two rear legs, i.e., the rear desktop lifting and moving profile 305, are lifted and lowered at the same time, and the whole desktop is lifted and lowered at the same time. When the rear desktop lifting and moving profile 305 moves upward, the front desktop lifting and moving profile 305 does not move, and the whole desktop is tilted. When the rear desktop lifting and moving profile 305 moves upward and the front desktop lifting and moving profile 305 moves upward at the same time, the whole desktop is raised. Conversely, the rotation of the rear leg lifting motor 315 and the front leg lifting motor 317 is controlled to finally realize that the desktop is at any height and any tilt angle.

Figure 29:
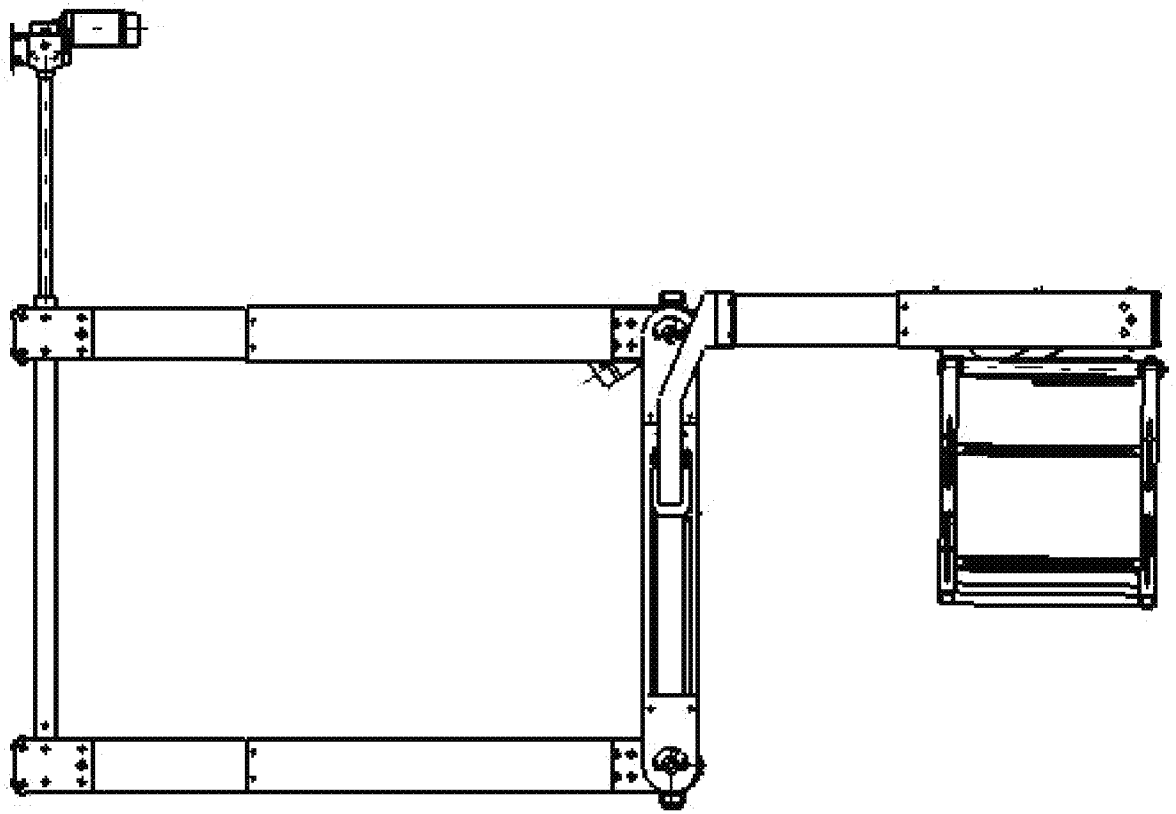
FIG. 29 is a schematic view of position during movement 4.
Figure 30:
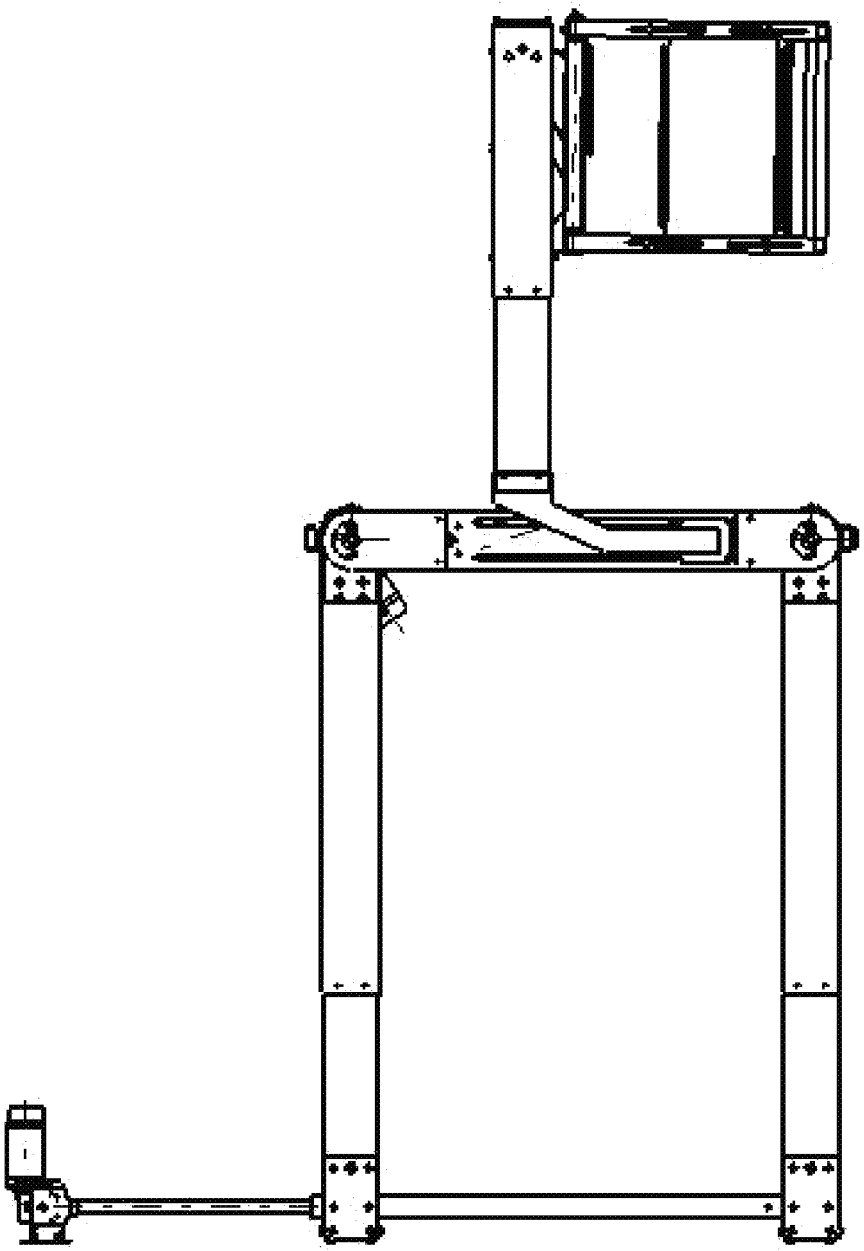
FIG. 30 is a schematic view of position during movement 5.

The working method of the monitor bracket's forward and backward movement adjustment: the movement state is shown in FIGS. 29-30, and the component positions refer to the corresponding views in the description. The front and rear movement motor 316 rotates clockwise to drive the screw drive rod 318 to rotate, and the screw drive rod 318 drives the screw gearbox A 322 to rotate. The screw gearbox A 322 drives the screw A 324 to rotate, and the screw A 324 rotates to drive the screw nut A 323 to move linearly. The screw nut A 323 drives the cantilever rack 310 to move linearly. The monitor lifting and tilting system is connected to the cantilever rack 310 through the screw rod 134, thereby driving the monitor lifting and tilting system to move forward and backward.

Figure 31:
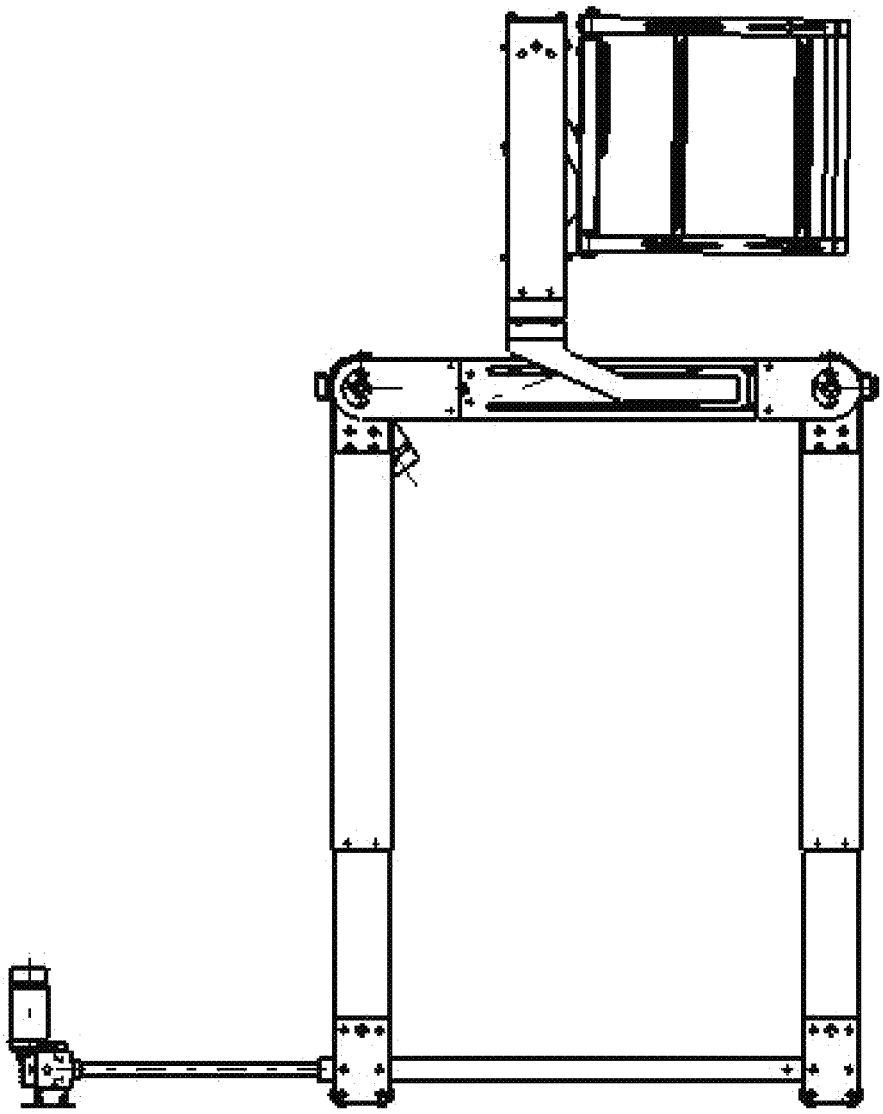
FIG. 31 is a schematic view of position during movement 6.

The working method of the up and down movement adjustment of the display bracket: the state view is shown in FIGS. 30 and 31, and the component positions refer to the corresponding views in the description. The drive motor 109 rotates clockwise to drive the drive shaft 111 to rotate, and the drive shaft 111 drives the screw gearbox 112 to rotate. The screw gearbox 112 drives the screw 114 to rotate. The screw 114 rotates to drive the screw nut 113 to move linearly downward. Since the screw nut 113 is fixed on the monitor frame lifting and fixing profile 102, it provides a reverse thrust to push the screw 114 to drive the screw gearbox 112 to move upward. Since the screw gearbox 112 is fixed on the monitor frame lifting and moving profile 103, it brings the monitor frame lifting and moving profile 103 to move upward. Conversely, the drive motor 109 rotates counterclockwise to move the monitor frame lifting and moving profile 103 downward.

Figure 32:
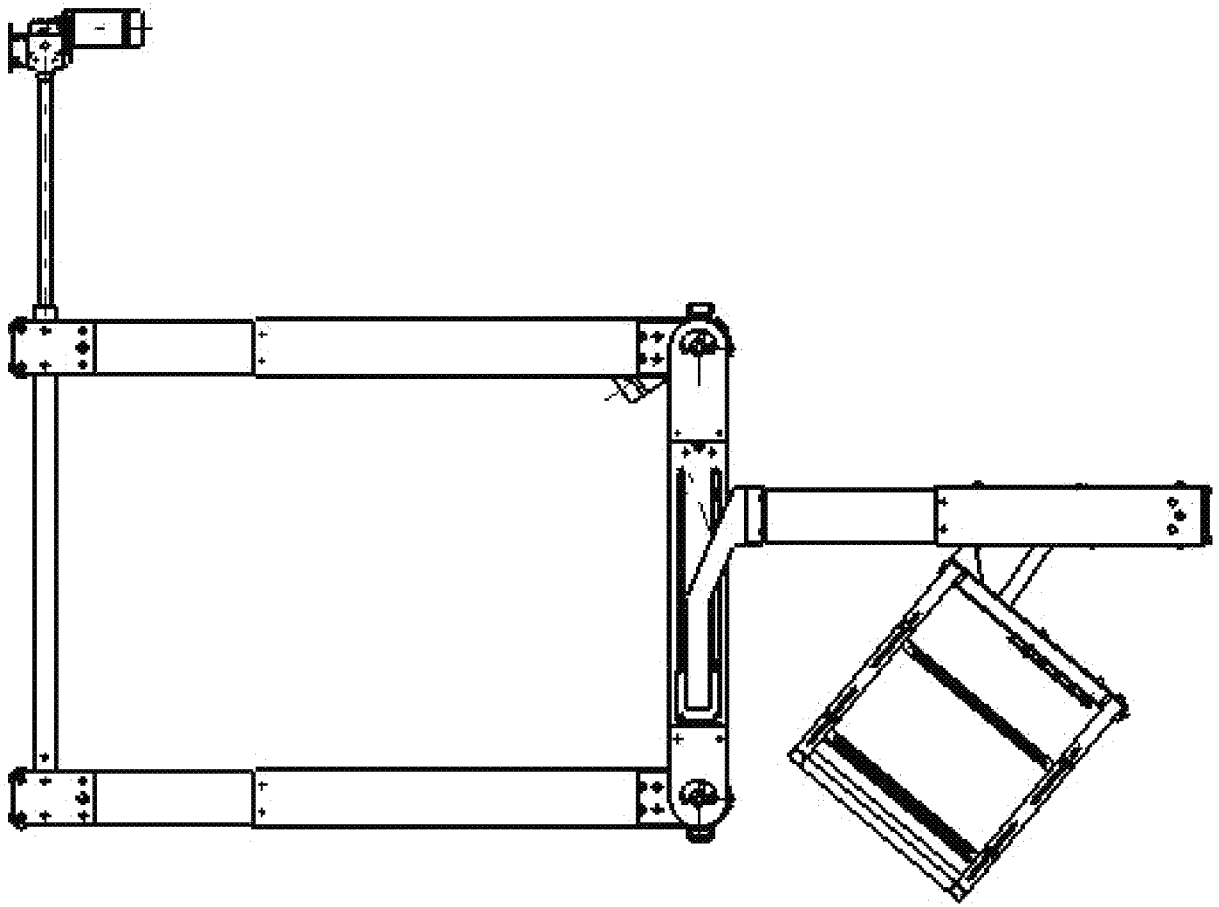
FIG. 32 is a schematic view of position during movement 7.
Figure 33:
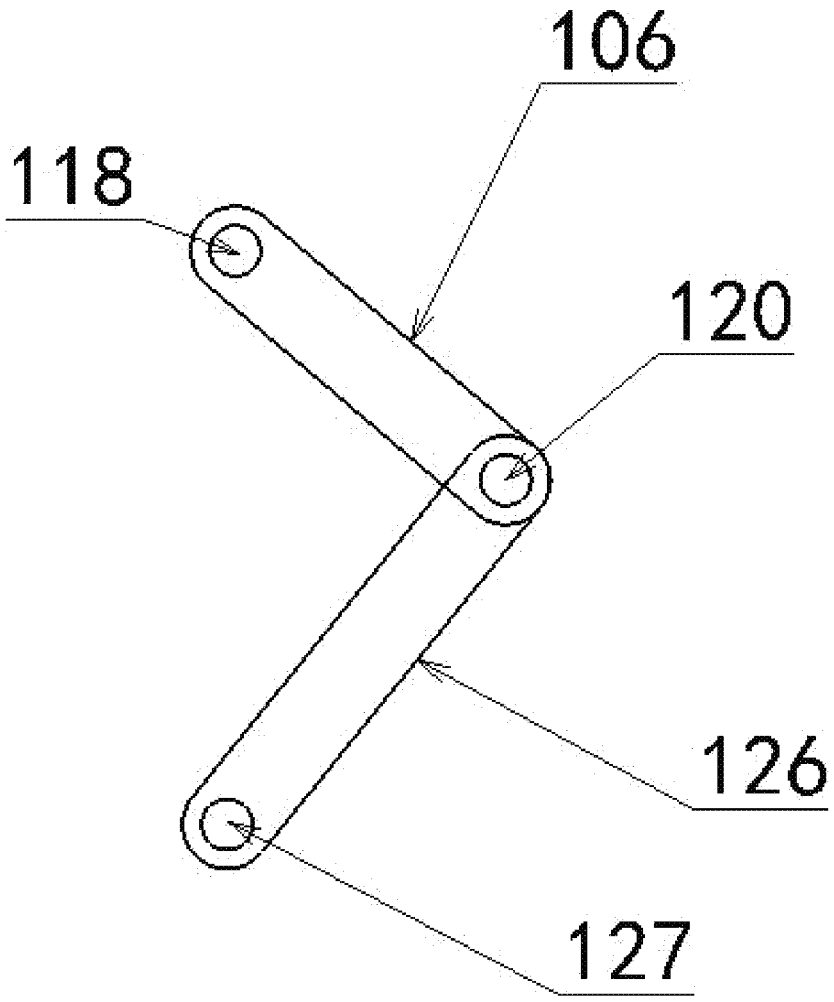
FIG. 33 is a simplified schematic view.

The working mode of the tilt adjustment of the monitor stand: the motion state is shown in FIGS. 30-32, and the component positions refer to the corresponding views in the description. The drive motor 109 rotates clockwise to directly drive the screw gearbox 112 to rotate, and the screw gearbox 112 drives the rotating screw 117. The rotating screw 117 rotates to drive the rotating and pushing nut 116 to move linearly, and the rotating and pushing nut 116 drives the mobile end pin 118 to move up and down. As shown in the simplified view of FIG. 33, the component positions refer to the corresponding views in the description, and the three hinge points of the mobile end pin 118, the rotating frame shaft 120, and the rotating fixed axis 127 and the rotating push frame 106 and the rotating support plate 126 form a triangular frame. When the mobile end pin 118 moves up and down, the rotating push frame 106 will change its angle, thereby achieving the purpose of angle adjustment.

Figure 34:
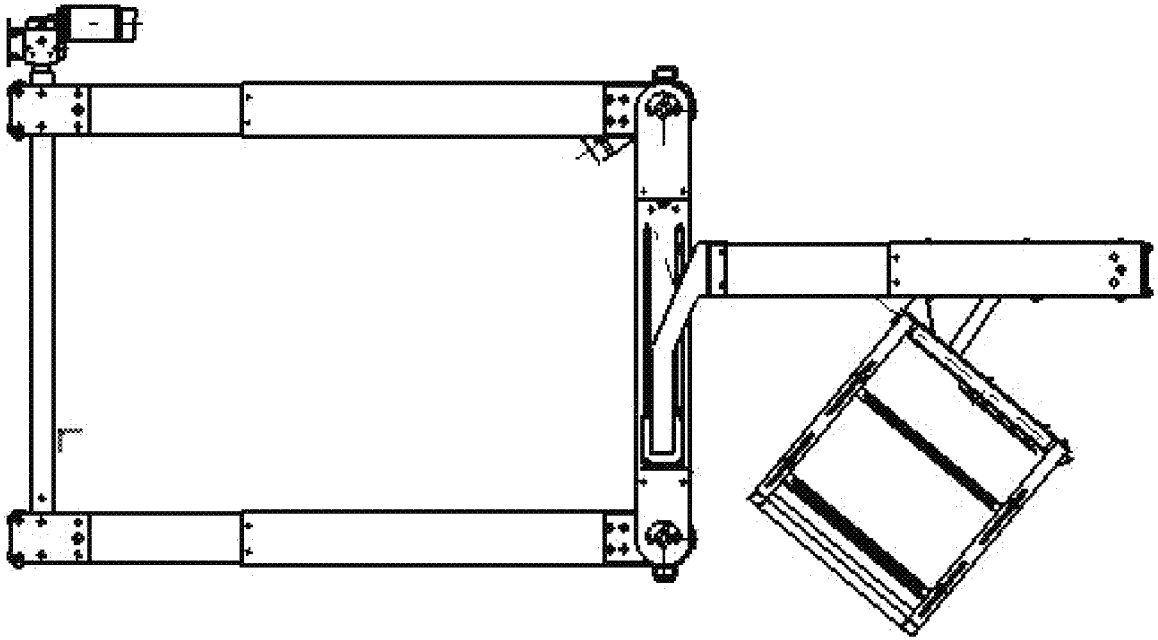
FIG. 34 is a schematic view of position during movement 8.

The working method of the entire desktop moving forward and backward: the movement state is shown in FIGS. 32 and 34, and the component positions refer to the corresponding views in the description. The frame moving motor 504 rotates to drive the screw drive rod 318 to rotate, the screw drive rod 318 drives the screw gearbox C 505 to rotate, the screw gearbox C 505 drives the Putter 506 to rotate, and the Putter 506 rotates to drive the screw C 507 to move linearly. Since the screw C 507 is fixed to the bottom longitudinal reinforcement beam 303, it drives the entire structure to move.

The invention claimed is:

1. An electric lifting and tilting table, comprising a monitor lift and tilt system, a desktop part, a desk lift and tilt system, a side storage rack and an overall forward and backward movement system; wherein the desktop part is installed on the desk lift and tilt system; wherein the monitor lifting and tilting system is installed on the desktop, and the monitor is installed on the monitor lifting and tilting system; wherein the desk lift and tilt system can adjust the height or tilt of the desktop, while the monitor lifting and tilting system can adjust the height or tilt of the monitor; wherein the overall forward and backward movement system can push the entire system to move forward and backward; wherein through these three adjustment systems, the monitor and the desktop can be kept in any position within a certain space;

wherein the components of the monitor lift and tilt system are a main support profile, a monitor frame lifting and fixing profile, a display frame lifting and moving profile, a monitor frame rotation fixing profile, an upper fixing plate, a rotating push frame, a rotation point fixing plate, a motor mount, a motor, a bottom fixing plate, a drive shaft, a screw gearbox, a screw nut, a screw, a built-in connecting plate, and a rotating and pushing nut; wherein a rotating and pushing nut, a rotating screw, a mobile end pin, a plug plate, a rotating frame shaft, a monitor converter board, a locking screw, a monitor horizontal support rod, a monitor vertical support bar, a monitor fixing plate, a rotating support plate, a rotating fixed shaft, a display extension rod, a rotating joint plate, a rotating joint support rod, an extended monitor horizontal support, extended monitor vertical support, extended display mounting plate, screw rod, the relationship between the components: the plug plate is welded to the bottom of the monitor frame lifting and fixing profile and then connected to the main support profile by bolts, the display frame lifting and moving profile is sleeved on the monitor frame lifting and fixing profile and can slide up and down, the display frame lifting and moving profile is welded together through the bottom fixing plate to form a support frame, and the built-in connecting plate is connected through Bolts are connected to the two side surfaces of the upper part of the display frame lifting and moving profile and the two side surfaces of the upper and lower ends of the monitor frame rotation fixing profile; the upper fixing plate is respectively connected to the built-in connecting plate by bolts to fix the display frame lifting and moving profile and the monitor frame rotation fixing profile; one end of the rotating driving frame is connected to the rotating driving nut through the moving end pin; the other end is connected to the monitor vertical support bar through the rotating driving frame shaft; wherein the rotation point fixing plate is welded to the bottom fixing plate, the motor is fixed to the motor mount by bolts, the motor mount is fixed to the display frame lifting and moving profile by bolts passing through the screw gear box, the drive shaft passes through the motor and the screw gear box, the screw nut is fixed to the top of the display frame lifting and fixing profile by pins and is also sleeved on the screw, the top of the screw is connected to the screw gear box, the rotating pushing screw is sleeved on the rotating pushing screw nut and is also connected to the screw gear box, the display is fixed on the monitor converter board, and then the monitor converter board is fixed to the monitor fixing plate by means of locking screws, the monitor horizontal support rod and the monitor vertical support bar are welded together to form a support frame, the rotation support plate is welded to the monitor horizontal support rod, the rotation fixing shaft passes through the rotation support plate and the rotation point fixing plate to form a rotation point, one end of the display extension rod is inserted into the monitor horizontal support rod, and the other end is connected to the rotation joint support rod through the rotation joint plate, one end of the extended monitor horizontal support is welded to the extended monitor vertical support, and the other end is connected to the rotation joint support rod through the rotation joint plate, and the extended display mounting plate is fixed to the extended monitor horizontal support by means of locking screws.

2. The electric lifting and tilting table of claim 1, wherein the desktop part in the components is composed of a main desktop, an extended desktop, a desktop transverse reinforcement beam, a desktop longitudinal reinforcement beam, an extended desktop splint, a guide shaft, a mouse magnet fixing block, a mouse connection cord, and an object anti-sliding block; The main desktop is installed on a frame welded together by the desktop transverse reinforcement beam and the desktop longitudinal reinforcement beam, wherein the main desktop is installed on a frame welded together by the desktop transverse reinforcement beam and the desktop longitudinal reinforcement beam; wherein the material is a material that can attract magnets; wherein the extended desktop splint is fastened to the extended desktop by bolts; wherein the guide shaft is installed on the extended desktop splint; wherein the mouse magnet fixing block is adsorbed to the main desktop; wherein at the same time, the mouse magnet fixing block is connected to one end of the mouse connection cord and the other end is connected to the mouse through a type C plug; wherein the magnet embedded in the object anti-sliding block can be adsorbed to the desktop, thereby preventing the object from sliding down when the desktop is tilted.

3. The electric lifting and tilting table of claim 1, wherein the components of the desk lift and tilt system are casters, a bottom hinge plate, a bottom longitudinal reinforcement beam, a desktop lifting fixed profile, a desktop lifting movable profile, a front and rear movable support beam, a transverse reinforcement, a front swivel plate, a rotating fixed plate, a cantilever rack, a pillar, a rear rotating plate, a front and rear movable motor mounting plate, a lifting Motor mounting plate, rear leg lifting motor, front and rear moving motor, front leg lifting motor, screw drive rod, bottom joint pin, isolation support plate, friction plate, screw gear box A, screw nut A, screw A, cantilever frame connecting pin, motor support plate support column, screw gear box B, screw nut B, screw B, rotating and pushing nut B, locking reinforcement plate, the relationship between the components: the bottom hinge plate connects the caster, the bottom longitudinal reinforcement beam, and the desktop lifting fixed profile to form a fixed hinge point through bolts, and the bottom hinge plate connects the caster and the desktop lifting fixed profile through the bottom joint pin; wherein the desktop lifting movable profile is sleeved on the desktop lifting fixed profile, and bolts are passed through the locking reinforcement plate, the friction plate, the desktop lifting movable profile, the screw gear box B, and the rotating fixed plate to form a hinge point; wherein the front swivel plate and the rear rotating plate are respectively fixed to the front swivel plate and the locking reinforcement plate by pins to form a rotatable hinge point; wherein bolts are passed through the front and rear movable support beams, the isolation support plate, and the front swivel plate to form a fixed connection at one end, and the other end is passed through the front and rear movable support beams and the isolation support plate by bolts; wherein the rear rotating plate is fixed, the transverse reinforcing rib is fixed on the top of the desktop lifting and moving profile to form a frame, the cantilever rack is connected to the nut A through the cantilever frame connecting pin, the nut A is sleeved on the rotating and pushing nut A, the rotating and pushing nut A is fixed on the rotating and pushing nut gearbox A, the bolt passes through the support and the lifting motor mounting plate and is fixed to the rotating fixed plate, the front and rear moving motor mounting plate is fixed to the rotating fixed plate through the pin, and the front and rear moving motor is fixed to the front and rear moving motor through the bolt; The rear leg lifting motor is fixed to the lifting motor mounting plate through the motor support plate support column, the front leg lifting motor is fixed to the lifting motor mounting plate through bolts, the nut B is fixed to the upper end of the desktop lifting fixed profile through a pin, one end of the rotating and pushing nut B is fixed to the rotating and pushing nut gearbox B, the nut B is sleeved on the rotating and pushing nut B, the rotating and pushing nut transmission rod passes through the rotating and pushing nut gearbox B, the rear leg lifting motor, the front and rear moving motor, the front leg lifting motor, the nut A.

4. The electric lifting and tilting table of claim 1, wherein the components of the side storage rack are a bottom storage platform, a vertical support rod, a horizontal pull rod, a side small table, a top-level framework connecting plate, and a top-level framework; wherein the components are related as follows: the vertical support rod is welded to the bottom storage platform, the horizontal pull rod is welded to the vertical support rod, the top-level framework connecting plate is welded to the top-level framework and the side small table, the frame fixing plate is welded to the desk lift and tilt system; wherein the desktop lifting and moving profile, the horizontal pull rod is fixed to the frame fixing plate by bolts.

5. The electric lifting and tilting table of claim 1, wherein the components of the overall forward and backward movement system are a fixed rod, a suction cup, a frame moving motor support plate, a frame moving motor, a screw gear box C, a putter, and a screw C; wherein the relationship between the components is as follows: the suction cup is installed on the fixed rod, the screw gearbox C and the frame moving motor are fixed on the frame moving motor support plate, the putter is connected to the screw C, and the screw C is fixed on the locking reinforcement plate of the desk lift and tilt system.

* * * * *